US011850846B2

(12) United States Patent
Garcia Maza et al.

(10) Patent No.: US 11,850,846 B2
(45) Date of Patent: Dec. 26, 2023

(54) METHODS, APPARATUS AND CONTROL SYSTEMS FOR DROPLET DEPOSITION APPARATUS

(71) Applicant: Xaar Technology Limited, Huntingdon (GB)

(72) Inventors: Jesus Garcia Maza, Huntingdon (GB); Nigel Heather, Huntingdon (GB); Tomas Cerny, Huntingdon (GB); Peter Boltryk, Huntingdon (GB); Mario Massucci, Huntingdon (GB)

(73) Assignee: Xaar Technology Limited, Huntingdon (GB)

( * ) Notice: Subject to any disclaimer, the term of this patent is extended or adjusted under 35 U.S.C. 154(b) by 142 days.

(21) Appl. No.: 17/602,955

(22) PCT Filed: Apr. 9, 2020

(86) PCT No.: PCT/GB2020/050937
§ 371 (c)(1),
(2) Date: Oct. 11, 2021

(87) PCT Pub. No.: WO2020/208369
PCT Pub. Date: Oct. 15, 2020

(65) Prior Publication Data

US 2022/0184942 A1 Jun. 16, 2022

(30) Foreign Application Priority Data

Apr. 11, 2019 (GB) ..... 1905170

(51) Int. Cl.
*B41J 2/045* (2006.01)

(52) U.S. Cl.
CPC ..... *B41J 2/04525* (2013.01); *B41J 2/04526* (2013.01); *B41J 2/04573* (2013.01);
(Continued)

(58) Field of Classification Search
CPC ..... B41J 2/04525
See application file for complete search history.

(56) References Cited

U.S. PATENT DOCUMENTS 6,719,390 B1 4/2004 Howkins et al.
7,445,306 B2 11/2008 Hirota
(Continued)

FOREIGN PATENT DOCUMENTS

CA 2200194 A1 4/1996
CN 101496060 A 7/2009
(Continued)

OTHER PUBLICATIONS

Thesis "Meniscus Motion and Drop Formation in Inkjet Printing" (chapter 3, pp. 29-51), Mark-Jan van der Meulen, Physics of Fluids, University of Twente, The Netherlands (2014)—downloadable from https://ris.utwente.nl/ws/portalfiles/portal/6054084/thesis_M_van_der_Meulen.pdf.
(Continued)

*Primary Examiner* — Shelby L Fidler
(74) *Attorney, Agent, or Firm* — Honigman LLP; Eric J. Sosenko; Jonathan P. O'Brien

(57) ABSTRACT

A method for reducing instability of a nozzle meniscus of a droplet deposition apparatus. The method includes the steps of receiving first and second data blocks for respective first and second line pixels, receiving a data set of forbidden pixel periods, determining a first jitter delay value based on the forbidden pixel periods, generating first and second print data based on the first and second data blocks, the first print data defining a first holding period and one or more drive pulses and the second print data defining one or more drive pulses; wherein the first and second print data generate first and second actuating element signals that cause an actuating element to eject at least one droplet from a nozzle, wherein the first jitter delay value adjusts a first pixel period, defined
(Continued)

by the drive pulses, to fall outside of the forbidden pixel periods to reduce nozzle meniscus instability.

21 Claims, 12 Drawing Sheets

(52) U.S. Cl.
CPC ..... *B41J 2/04581* (2013.01); *B41J 2/04588* (2013.01); *B41J 2/04595* (2013.01)

(56) References Cited

U.S. PATENT DOCUMENTS

| | | | | |
|---|---|---|---|---|
| 9,522,533 | B1 | 12/2016 | Seto et al. | |
| 2002/0101465 | A1* | 8/2002 | Maeda | B41J 2/04525 347/12 |
| 2005/0073537 | A1 | 4/2005 | Iwao | |
| 2006/0013097 | A1 | 1/2006 | Kakuichi et al. | |
| 2006/0092196 | A1 | 5/2006 | Iwao et al. | |
| 2007/0200889 | A1 | 8/2007 | Iriguchi | |
| 2010/0220134 | A1* | 9/2010 | Matsushita | B41J 2/04581 347/10 |
| 2013/0063511 | A1 | 3/2013 | Gardner et al. | |
| 2015/0210073 | A1 | 7/2015 | Yamagata | |
| 2018/0147836 | A1 | 5/2018 | Klerken | |
| 2019/0070850 | A1 | 3/2019 | Suetomi et al. | |
| 2019/0126611 | A1* | 5/2019 | Lahiri | B41J 2/04541 |

FOREIGN PATENT DOCUMENTS

| | | | |
|---|---|---|---|
| CN | 103313855 | A | 9/2013 |
| CN | 105451999 | A | 3/2016 |
| EP | 3436273 | A1 | 2/2019 |
| JP | 2006095827 | A | 4/2006 |
| JP | 2006231632 | A | 9/2006 |
| JP | 2016032872 | A | 3/2016 |
| JP | 2016032873 | A | 3/2016 |

OTHER PUBLICATIONS

"Acoustic excitation of superharmonic capillary waves on a meniscus in a planar microgeometry", Jie Xu and Daniel Attinger, Physics of Fluids 19, 108107 (2007).

* cited by examiner

METHODS, APPARATUS AND CONTROL SYSTEMS FOR DROPLET DEPOSITION APPARATUS

CROSS REFERENCE TO RELATED APPLICATIONS

This application is a national stage entry of international application no. PCT/GB2020/050937, filed Apr. 9, 2020, which is based on and claims the benefit of foreign priority under 35 U.S.C. 119 to GB 1905170.5, filed Apr. 11, 2019. Where permissible, the entire contents of the above-referenced applications are herein expressly incorporated by reference.

FIELD OF INVENTION

The present invention relates to methods, apparatus and control systems for a droplet deposition apparatus. It may find particularly beneficial application in a printer including a droplet deposition head, such as an inkjet printhead, and methods and a control system therefor.

BACKGROUND

Droplet deposition apparatus has been used extensively in a variety of applications, such as inkjet printing, 3D printing, or other materials deposition or rapid prototyping techniques. As may be expected, different applications have different requirements, including the jetting of different fluids with different chemical properties onto different media.

Different media pose different and increasingly-challenging demands on deposition methods and apparatus. As such, the field of droplet deposition apparatus continues to evolve and specialise, facing new and demanding problems and continuously procuring new improvements and solutions.

SUMMARY

Aspects of the invention are set out in the appended independent claims, while particular embodiments of the invention are set out in the appended dependent claims.

According to a first aspect of the invention there is provided a method for reducing nozzle meniscus instability of a droplet deposition apparatus, the method comprising the steps of:

(a) receiving a first data block for a first line pixel and a second data block for a second line pixel;

(b) receiving a data set of forbidden pixel periods that cause harmonic/subharmonic excitation of the meniscus surface and lead to meniscus instability;

(c) determining a first jitter delay value based on the data set of forbidden pixel periods;

(d) generating first print data based on the first data block, wherein the first print data comprises data defining a first holding period, determined by the first jitter delay value, and one or more drive pulses; and (e) generating second print data based on the second data block, wherein the second print data comprises data defining one or more drive pulses, the time between each first of the one or more drive pulses defined by the first and second print data determining a first pixel period;

wherein the first and second print data are for generating a first and second actuating element signals for controlling at least one actuating element of the droplet deposition apparatus according to the first and second print data;

such that each drive pulse causes the actuating element to eject at least one droplet from a respective nozzle of the droplet deposition apparatus; and the first jitter delay value adjusts the first pixel period to fall outside of the data set of forbidden pixel periods so as to reduce the occurrence of nozzle meniscus instability.

According to a second aspect of the invention there is provided a control system for a droplet deposition apparatus, the control system being configured to implement the method according to the first aspect of the invention.

According to a third aspect of the invention there is provided a control system for a droplet deposition apparatus, the control system comprising a first controller configured to implement the method according to the first aspect of the invention, and a second controller configured to implement one or more further steps.

According to a fourth aspect of the invention there is provided a computer program which, when executed by one or more controllers of a droplet deposition apparatus, causes the controller(s) to carry out the method according to the first aspect of the invention.

BRIEF DESCRIPTION OF THE DRAWINGS

Reference is now directed to the drawings, in which.

In the Figures, like elements are indicated by like reference numerals throughout.

DETAILED DESCRIPTION

Figure 1A:
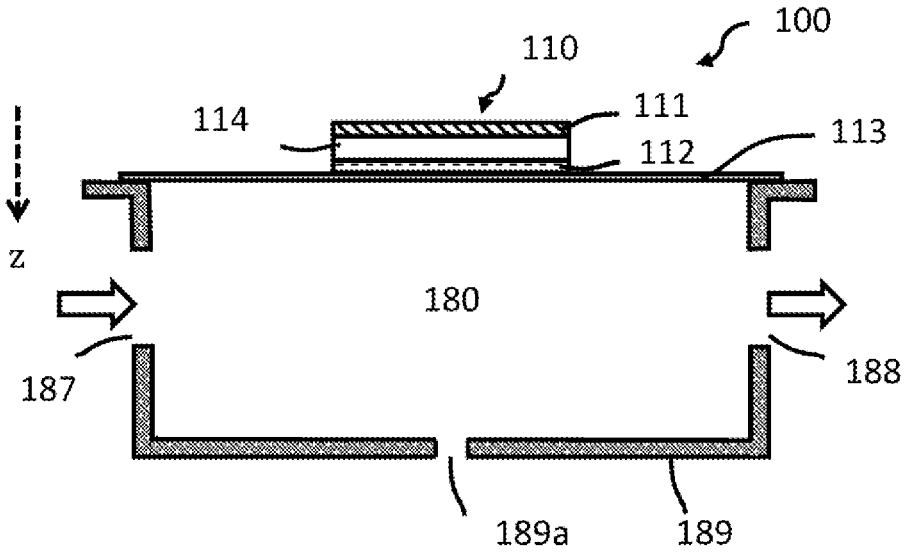
FIG. 1A is a schematic cross sectional view of a known actuator apparatus.
Figure 1B:
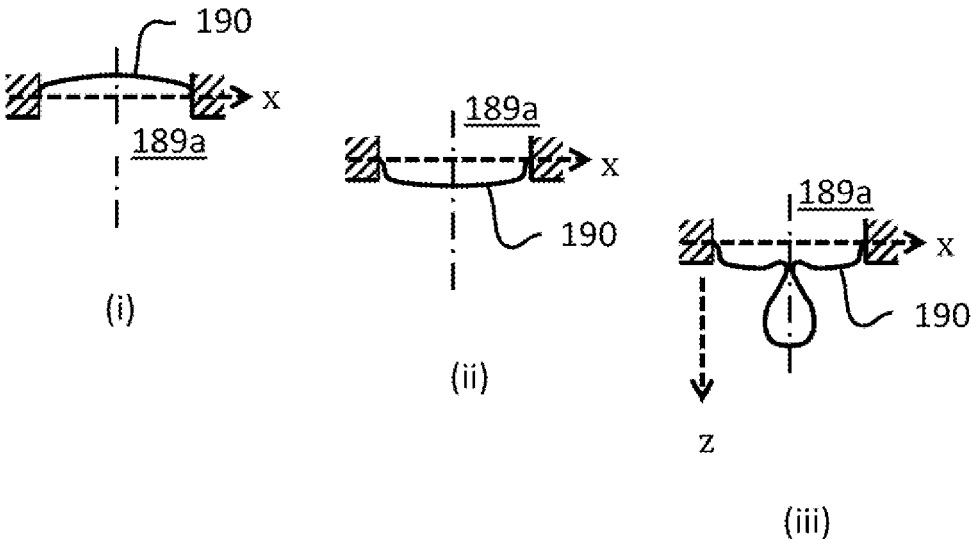
FIG. 1B is a series of schematic cross sectional views of a meniscus surface within the nozzle of the apparatus of FIG. 1A, during the ejection cycle of a droplet.

To highlight the functionality of the embodiments and their various implementations that will be described with respect to FIGS. 2-11, reference is initially made to a known actuator apparatus as shown in FIGS. 1A and 1B.

There are several types of droplet deposition apparatus which enable deposition of ink directly onto media. Generally, ink is ejected through a nozzle in a pressure chamber as a result of pressure variation induced by an actuating element. As illustrated schematically in FIG. 1A, an example of such apparatus comprises an actuator 100 comprising at least one piezoelectric actuating element 110 and a corresponding fluid chamber 180 bounded in part by a nozzle plate 189 having a nozzle 189*a*. The piezoelectric actuating element 110 comprises a piezoelectric member 114 and first and second electrodes 111 and 112 on opposing sides of the piezoelectric member 114. When a drive pulse is applied to the electrodes 111 and 112, the piezoelectric actuating element 110 deforms and changes the pressure inside the fluid chamber 180. The cycle in pressure change due to the drive pulse causes the meniscus 190 within the nozzle 189*a* to oscillate between a minimum and a maximum position along the z direction, thereby releasing the droplet along the z direction as shown in FIG. 1B.

FIG. 1B shows the nozzle 189*a* and the profile of the meniscus 190 in cross section through the nozzle axis, over three stages of droplet ejection during the application of a drive pulse to the actuating element. FIG. 1B(i) illustrates the meniscus profile 190 while the actuating element (not shown) draws ink into the pressure chamber, creating a low pressure behind the meniscus and giving it a concave shape. FIG. 1B(ii) illustrates the meniscus profile 190 during early increase in pressure behind the meniscus, for example by the actuating element 110 starting to move inwards of the chamber, and giving the meniscus a convex shape. FIG. 1B(iii) shows the meniscus with a droplet almost formed but still attached, just before the droplet is ejected. After ejection, the meniscus will snap back and oscillate briefly between (i) and (ii) before stabilising. This illustration relates to stable meniscus behaviour, where the profile is symmetric about the nozzle diameter and droplet ejection occurs, for an ideal nozzle, along the nozzle axis.

The droplet properties such as droplet volume and velocity are typically determined by the nature of the drive pulse and the pressure acoustics of the pressure chamber. The directionality of the ejected droplet is typically determined by the quality of the nozzle, and may vary with manufacturing variability in the finish of the nozzle shape and surface.

The present inventors surprisingly found that within high print frequency regimes, above e.g. 30 kHz, and up to at least 100 kHz, significant droplet deviation and other drop anomalies may occur at certain high frequency bands that are not related to manufacturing variability. The observations of the deviations and anomalies and embodiments that reduce or prevent them will now be described.

Droplet ejection timings are normally determined in relation to pixel lines defined on the media that is to be printed. A pixel line represents the location of one line of pixels based on image data that the printhead has to fill as the media passes underneath. The print frequency f at which droplets are to be ejected from the nozzles into the same pixel line is therefore typically related to the speed of the media and is the inverse of the pixel period, i.e. $f=1/\tau$, where $\tau$ is the pixel line period (hereinafter also referred to as pixel period) between a first and second set of drive pulses of consecutive pixel line signals, and where each pixel line signal comprises at least one drive pulse.

Figure 2A:
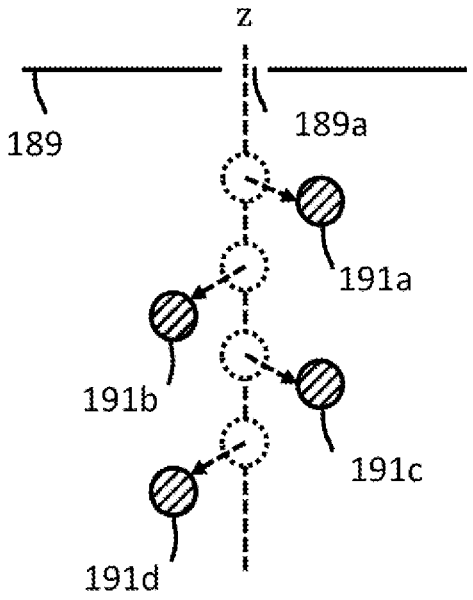
FIG. 2A is a schematic of droplets ejected by an actuating element signal having a so-called "forbidden pixel period" that gives rise to meniscus instability and consequential droplet deviation.

FIG. 2A shows, as unfilled circles with a dotted outline, a representation of the ideal ejection direction along the z-direction, or nozzle axis, of four successive droplets from a nozzle 189*a* in the nozzle plate 189. However when printing at certain high frequencies, unusual droplet behaviour may be observed, such as forking or droplet merging. When forking is observed, droplets 191*a* to 191*d* are ejected in significantly deviated directions towards the media, as also shown in FIG. 2A by hatched, solid outline circles. Every second droplet, here droplets 191*a* and 191*c*, are deviated to the right, while alternate droplets 191*b* and 191*d* are deviated to the left in relation to the z direction. It was further observed that changing nozzle size and/or changing the ejection fluid changes the frequency band at which this type of deviation is observed. The significance of the deviations leads to visible artefacts in the printed output on the media. A second effect observed at certain high frequency bands is drop merging, where a first drop is caught up by the subsequent drop from the same nozzle intended for the consecutive pixel on the media. This leads to one large drop in the first pixel and a missing drop in the consecutive pixel.

It was further found that by avoiding specific print frequencies, and therefore specific pixel periods—that will subsequently be referred to as "forbidden" pixel periods—the described anomalies can be avoided or at least reduced. It is at present assumed that the observed effects of deviations and other anomalous droplet effects such as successive drops merging are due to meniscus asymmetries, hereafter referred to as meniscus instabilities.

While avoiding certain print periods may be a mitigation mechanism during constant media speeds, all applications require a start-up period during which the printhead accelerates or decelerates relative to the media. For example, for a static system of printheads, the media speeds up underneath the printheads until it reaches full media speed, and slows down again ahead of completion of the printing process. To avoid wasting media, during acceleration and deceleration of the media, the pixel line frequency is continuously adjusted corresponding to the media speed, so that the pixel line frequency sweeps from low to high pixel line frequency upon media acceleration, and from high to low pixel line frequency during media deceleration, sweeping through the forbidden pixel periods. Therefore, the problematic frequency bands cannot easily be avoided. Similarly, in a scanning application, the printheads move back and forth across the media while the media advances in an orthogonal direction to the scanning direction. Each scan line requires acceleration and deceleration of the printheads and for the same reasons as for the static setup, it is desirable to continue printing while the printheads change speed.

It is therefore necessary to provide solutions that avoid the occurrence of frequency-dependent meniscus instability found at range(s) of forbidden pixel periods that lead to frequency-dependent droplet anomalies, and that allow a high target print frequency to be reached while printing during acceleration/deceleration, while avoiding visible artefacts on the media. Various embodiments describing such solutions will now be explained with respect to FIGS. 4 to 11.

Figure 4:
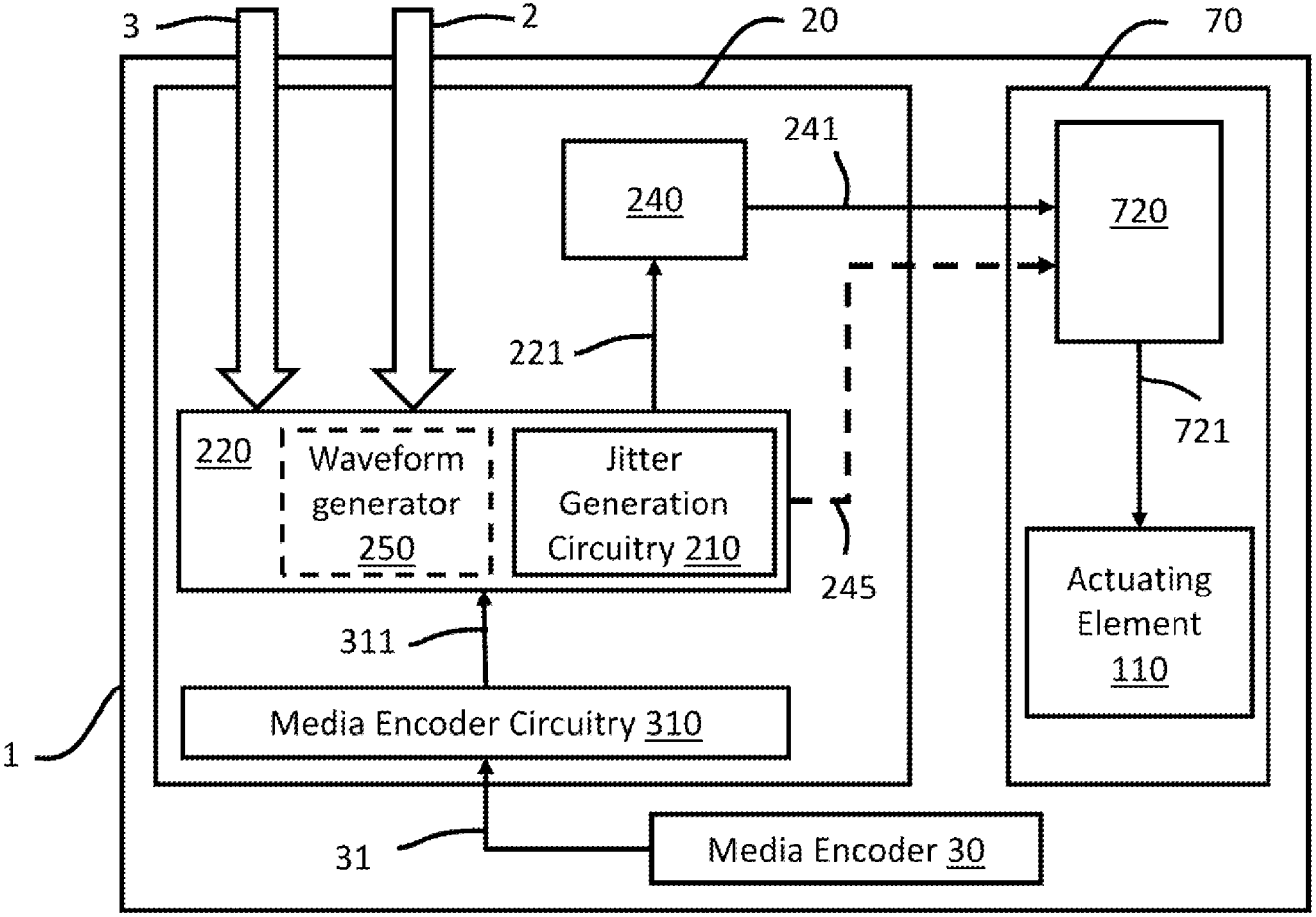
FIG. 4 is a block diagram of a droplet deposition apparatus in accordance with embodiments of the invention, configured to carry out operations and methods related to applying jitter delay values.

Droplet Deposition Apparatus, Including Processing Circuitry Comprising Jitter Generation Circuitry Turning first to FIG. 4, a block diagram is shown that illustrates schematically a droplet deposition apparatus 1 according to embodiments of the invention. The droplet deposition apparatus 1 includes a printhead 70 that comprises at least one actuating element 110, such as that comprised within actuator 100 of FIG. 1. The droplet deposition apparatus 1 further comprises a controller 20 and a media encoder 30. The controller 20 includes processing circuitry 220, a print data generating circuit 240, and media encoder circuitry 310.

The processing circuitry 220 is configured to receive data blocks 2 for specific pixel lines on the media, and a data set 3 of forbidden pixel periods, for example from image processing circuitry comprised in a personal computer.

The media encoder 30 is configured to supply the media encoder circuitry 310 of the controller 20 with a media encoder input 31, which contains data relating to the characteristics of the medium on which the ink is to be deposited. In turn, the media encoder circuitry 310 is configured to supply the processing circuitry 220 with a media encoder signal 311 that comprises a virtual pixel clock VPCLK and specifies the triggers for when each actuating element is to be controlled so that the deposited droplets accurately fill the pixels on the media.

The processing circuitry 220 is configured to receive the media encoder signal 311 provided by the media encoder circuitry 310.

The controller 20 further includes jitter generation circuitry 210 comprised within the processing circuitry 220. The jitter generation circuitry 210 is configured to determine jitter delay values based on the data set 3 of forbidden pixel periods, and to generate a control signal 221 comprising modified virtual pixel clock triggers based on a virtual pixel clock and the jitter delay values. The control signal 221 is sent to the print data generating circuit 240. As described in greater detail below, the jitter delay values serve to adjust (extend or shorten) certain pixel periods, by adjusting the virtual pixel clock, to fall outside of the data set 3 of forbidden pixel periods, so as to reduce the occurrence of nozzle meniscus instability.

The print data generating circuit 240 is configured to receive the control signal 221 from the processing circuitry 220, and to generate print data 241 based on the data blocks 2 and the control signal 221 based on jitter delay values, and to send the print data 241 to head control circuitry 720. The print data comprises data necessary for the head control circuitry 720 to generate actuating element signals comprising at least one drive pulse and a holding period.

The head control circuitry 720 is configured to generate corresponding actuating element signals 721 for controlling the at least one of the actuating elements 110.

Depending on the configuration of the head control circuitry 720 and the controller 20, in one implementation the data blocks 2 are analysed and a waveform comprising the minimum number of drive pulses for all pixel blocks is generated within the processing circuitry 220, for example by a waveform generator 250. This waveform may be a waveform that is common to the at least one actuating element 110. The waveform generator 250 is configured to send a waveform signal 245 to the head control circuitry 720, and the head control circuitry 720 is configured to generate an actuating element signal 721 from the waveform signal 245 based on the print data. For example, the print data 241 may comprise certain triggers that determine when the head control circuitry is to switch the actuating element to the common drive waveform to follow a certain number of the common drive waveform pulses, and when to uncouple the actuating element from the common drive waveform. This means that some of the drive pulses of the common drive waveform may not be used to generate actuating element drive pulses. Such an implementation utilises some of the principles of so-called 'cold' switching.

Alternatively, a 'hot switch' approach may be followed, where the head control circuitry 720 comprises a waveform generator 250 and generates a waveform signal based on print data 241 and provides it as actuating element signal 721 to the actuating element 110. In this case, the control signal 221 may be an analogue signal that defines the timing and shape of the pulses, including amplitude, rise times, fall times and the holding time following the drive pulses, and this information may be sent as part of print data 241 to the head control circuitry 720.

The following discussion will explain various methods that may be implemented by the controller 20 to determine and apply jitter delay values, so as to cause certain pixel periods to fall outside of the data set 3 of forbidden pixel periods, and thereby reduce the occurrence of nozzle meniscus instability.

Processing Methods

In a general sense, a presently-preferred method for reducing nozzle meniscus instability of the droplet deposition apparatus 1 comprises the steps of receiving, in the data blocks 2, a first data block for a first line pixel and a second data block for a second line pixel; receiving a data set 3 of forbidden pixel periods that cause harmonic/subharmonic excitation of the meniscus surface and lead to meniscus instability; determining, by the jitter generation circuitry 210, a first jitter delay value based on the data set 3 of forbidden pixel periods; and generating, by the print data generating circuit 240, first print data 241 based on the first data block. The first print data 241 comprises data defining a first holding period 243, determined by the first jitter delay value J, and one or more drive pulses 242.

The method further comprises generating, by the print data generating circuit 240, second print data 241 based on the second data block. The second print data 241 comprises data defining one or more drive pulses 242, the time between each first of the one or more drive pulses defined by the first and second print data 241 determining a first pixel period.

The first and second print data 241 are for generating first and second actuating element signals 721 for controlling at least one actuating element 110 of the droplet deposition apparatus according to the first and second print data 241, such that each drive pulse 242 causes the actuating element 110 to eject at least one droplet from a respective nozzle of the droplet deposition apparatus, and the first jitter delay value adjusts the first pixel period to fall outside of the data set of forbidden pixel periods so as to reduce the occurrence of nozzle meniscus instability. Such a method may be carried out by 'hot switch' apparatus in which the head control circuitry 720 generates all of the actuating element signals based on print data, or by 'cold switch' apparatus having a common waveform generator supplying waveform signals to the head control circuitry alongside the print data and from which the actuating element signals are generated.

Furthermore, the method may comprise the step of sending, by the print data generating circuit 240, the first and second print data 241 to head control circuitry 720 for generating the first and second actuating element signals 721 for controlling at least one actuating element 110 of the droplet deposition apparatus according to the first and second print data.

Further still, the above methods may comprise the step of generating, by head control circuitry 720, first and second actuating element signals 721 based on respective first and second print data 241, to control at least one actuating element 110 of the droplet deposition apparatus according to the first and second print data 241.

Where the apparatus comprises a common waveform generator 250, the method may further comprise the step of generating a stream of at least one common drive waveform 245 (common drive waveform signal 245) for generating the actuating element signal of the one or more actuating element 110 based on the first and second print data 241 (where the first and second print data are based on the first and second data blocks 2). The stream of the common drive waveform may further be synchronised with the (first, second, third . . . ) print data 241 to ensure that the print data can be applied to generate the actuating element signal 721 at the correct time with respect to the specific locations in the common drive waveform. The method may further comprise the step of sending the common drive waveform signal 245 to head control circuitry to generate the first and second actuating element signals 721 for the at least one actuating element 110 of the droplet deposition apparatus from the common drive waveform signal 245 based on the first and second print data 241 (which are in turn based on the first and second data blocks of data blocks 2).

Additionally the method may comprise the step of generating the first and second actuating element signals 721 from the common drive waveform signal 245 based on the respective first and second print data 241 to control the at least one actuating element 110 of the droplet deposition apparatus.

Figure 5A:
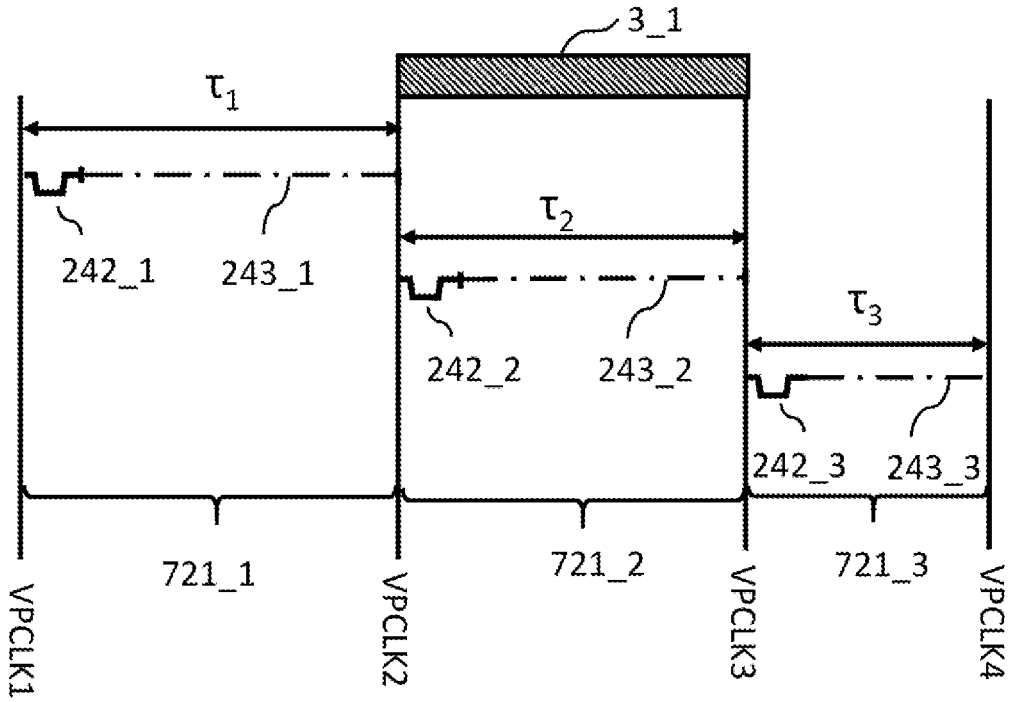
FIG. 5A is an illustration of an actuating element signal sequence where no jitter delay value is applied to a forbidden pixel period.

To explain in more detail the effect of applying the jitter delay, FIG. 5A schematically illustrates an example sequence of actuating element signals 721_1 to 721_3 applied to an actuating element 110 of the droplet deposition apparatus 1 in the absence of the application of jitter delay values. In this Figure, as well as in FIGS. 5B, 5C, 7 and 11, actuating element signals 721_*n* are offset vertically to help distinguish them from one another, while the timing and durations of events such as virtual pixel clock triggers, drive pulse(s) 242_*n*, holding periods 243_*n*, and jitter delay values Jn etc, are illustrated along the horizontal direction representing the lapse of time.

For simplicity, a binary printing example is shown in the first instance in FIG. 5A, where each actuating element signal 721 comprises one pulse 242 which causes the actuating element 110 to eject one droplet from a respective nozzle 189*a* of the droplet deposition apparatus 1. Each actuating element signal 721 further comprises a holding period 243, which is a period during which no further drive pulses are applied in that pixel period. Each actuating element signal 721 starts with a first drive pulse 242, and the duration between first pixel pulses in each actuating element signal defines the pixel period T. The period of the first actuating element signal 721_1 is therefore $\tau_1$, the period of the second actuating element signal 721_2 is $\tau_2$ and the period of the third actuating element signal 721_3 is $\tau_3$. It can be seen that in the illustration of FIG. 5A, the pixel periods decrease over time so that $\tau_1>\tau_2>\tau_3$, which may be due to a ramp-up of media speed. The relative speed between media and printhead is synchronised with the droplets ejected by the actuating elements generally as follows.

The input 31 from the media encoder 30 relates to media speed and the relative position of the printhead to the media along the printing direction. This input may then be used by the media encoder circuitry 311 to define pixel clock triggers PCLKn for n pixels on the media.

Pixel clock triggers PCLKn are typically adjusted by circuitry of the droplet deposition apparatus 1 for encoder or process errors and the like, and are converted into a virtual pixel clock VPCLK having virtual pixel clock triggers, VPCLKn. While in some cases the virtual pixel clock triggers may be used to trigger actuating element signals, in that they directly define the start of the first drive pulse 242 within a pixel period, in other cases these virtual pixel clock triggers may be used to define the timings of print data 241, which in turn determine the timings of first and second actuating element signals 721_1 and 721_2. The data in the print data 241 may further be used to define timing for when to generate each drive pulse 242 to control the at least one actuating element of the droplet deposition apparatus according to the first and second data blocks 2_1 and 2_2. This is described in more detail in the further description of FIG. 4.

The virtual pixel clock VPCLK relates to positions on the media at which a pixel should ideally be filled by droplets. Accordingly, pixel clock signals VPCLK1-4 define ideal pixel periods that gradually decrease in period, i.e. the time $\Delta t_1$ (VPCLK$\mathbf{2}_0$−VPCLK1)>$\Delta t_2$ (VPCLK3−VPCLK2)>$\Delta t_3$ (VPCLK4−VPCLK3), which in this case correspond to $\tau_1>\tau_2>\tau_3$.

FIG. 5A further shows that the ideal pixel period $\Delta t_2$ (VPCLK3−VPCLK2) is a forbidden pixel period 3_1 of the data set of forbidden pixel periods.

Figure 5B:
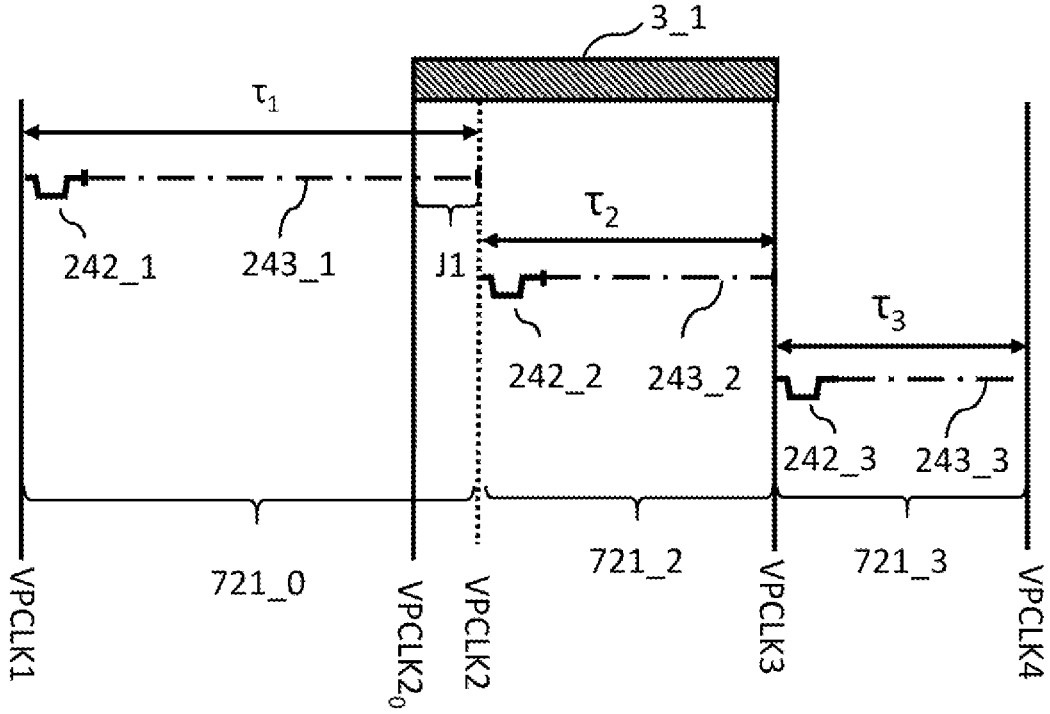
FIG. 5B is an illustration of an actuating element signal sequence where a positive jitter delay value is applied to a forbidden pixel period.

Next it will be described how, in accordance with embodiments of the invention, application of a jitter delay value may mitigate meniscus instability. Turning to FIG. 5B, in one implementation the ideal pixel periods may be adjusted by applying a jitter delay value in order to adjust the ideal pixel period $\Delta t_2$ to a period $\tau_2$ that falls outside of the data set of forbidden pixel periods. This is achieved by extending the holding period 243_1 of the first actuating element signal 721_1 by a jitter delay value J1. The jitter delay value J1 is chosen so that the forbidden pixel period $\Delta t_2$ becomes an 'allowable' pixel period $\tau_2$, while optionally ensuring that the first pixel period $\tau_1$ does not become a forbidden pixel period. In this case the ideal virtual pixel clock trigger for the second actuating element signal, here VPCLK$\mathbf{2}_0$, is not used as basis for a trigger to trigger the drive pulse of the next actuating element signal 721_2. Instead, it is modified by the jitter delay value J1 into a virtual pixel clock VPCLK2 that is instead used to trigger the next actuating element signal 721_2 at the end of the adjusted holding period 243_1, which now is extended by the duration of the jitter delay value J1. The ideal period $\Delta t_2$ is therefore adjusted to $\tau_2$=(VPCLK3−VPCLK2). In this way, the occurrence of nozzle meniscus instability is prevented or reduced.

Therefore the above methods, where the second print data 241_2 comprises data defining a second holding period 243_2, may further comprise the steps of receiving a third data block for a third line pixel; and generating third print data 241_3 based on the third data block. The third print data comprises data defining one or more drive pulses 242, and the time between each first of the one or more drive pulses defined by the second and third print data 241_2 and 241_3 determines a second pixel period, and the second pixel period is adjusted by the first jitter delay value to fall outside the data set of forbidden pixel periods. Additionally, the step of determining a first jitter delay value may be followed by the step of determining modified virtual pixel clock triggers based on the first jitter delay value, and generating the first and second print data based on the modified virtual pixel clock triggers.

In the implementation of FIG. 5B, the jitter delay value J1 applied to the first holding period 243_1 of the first actuating element signal shortens the holding period 243_2 of the second signal having the forbidden pixel period $\Delta t_2$ so that it assumes a value $\tau_2$ that falls outside of the data set of forbidden pixel periods. J1 also extends the first holding period 243_1 and therefore the pixel period $\tau_1$. It may be necessary to ensure that the period of the so-adjusted first actuating element signal 721_1 still falls outside of the data set of forbidden pixel periods. This may be done by identifying an appropriate value of J1, or additionally, or instead, selecting a value for J1 that extends the holding period 243_2 of the second signal having the forbidden pixel period $\Delta t_2$ so that it assumes a value $\tau_2$ that falls outside of the data set of forbidden pixel periods.

Figure 5C:
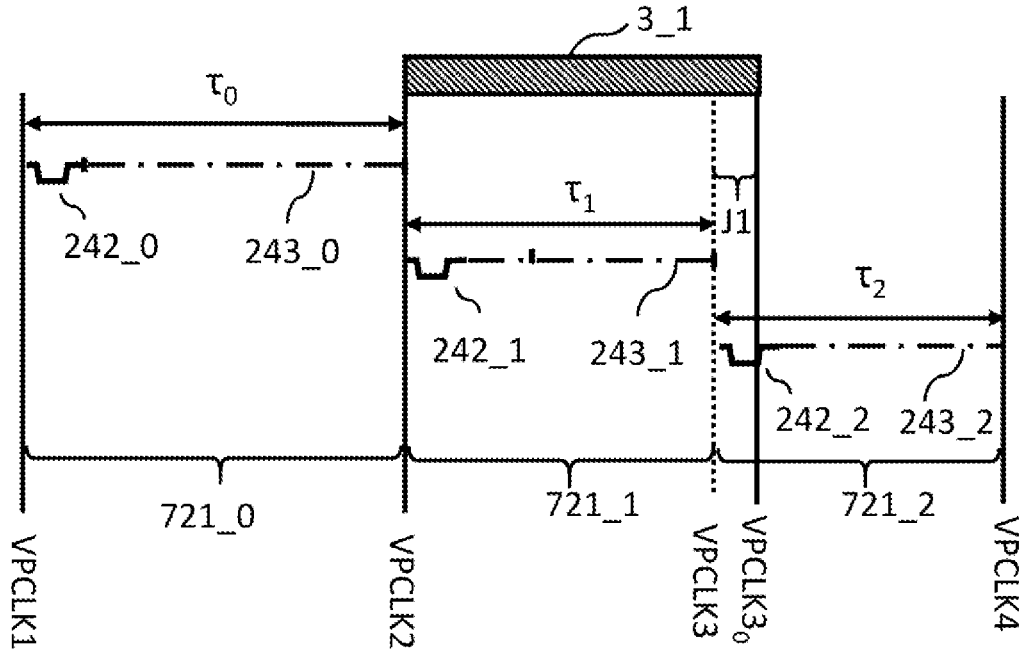
FIG. 5C is an illustration of an actuating element signal sequence where a negative jitter delay value is applied to a forbidden pixel period.

FIG. 5C describes how, in an alternative implementation, a jitter delay value J1 may be chosen that shortens a holding period so that the period of the actuating element signal falls outside of the data set of forbidden pixel periods. The initial pixel periods unadjusted by jitter according to the unadjusted pixel clock triggers in this alternative implementation are: $\Delta t_0$=(VPCLK2−VPCLK1); $\Delta t_1$=(VPCLK30−VPCLK2); and $\Delta t_2$=(VPCLK4−VPCLK3$_0$). FIG. 5C shows that $\Delta t_1$ is a forbidden pixel period 3_1 of the data set of forbidden pixel periods. $\Delta t_1$ may be adjusted to fall outside of the data set of forbidden pixel periods by applying a jitter delay value J1 that brings forward the drive pulse of the second actuating element signal 721_2, so that the second drive pulse of the third actuating element signal effectively falls within the initial holding period 243_2 of the actuating element signal 721_2. The effect of J1 is that the ideal virtual pixel clock trigger, VPCLK3$_0$, is adjusted to VPCLK3, which provides a temporally advanced trigger to initiate the second actuating element signal 721_2.

J1 in this case is, in effect, a negative jitter delay value that is subtracted from the initial holding period and thus shortens the holding period 243_1, and thereby the pixel period $\tau_1$, of the first actuating element signal 721_1. Furthermore, in the absence of adjustment of the end of the second pixel period, such as by applying a positive jitter delay value J2 to the second holding period 243_2, J1 has the effect of lengthening (i.e. extending) the pixel period $\Delta t_2$=(VPLCK4−VPCLK30), which becomes the adjusted pixel period $\tau_2$=(VPLCK4−VPCLK3) of the second actuating element signal 721_2.

It can therefore be seen how the specific location of the jitter delay value or its mathematical application between the first drive pulse of successive actuating element signals is not important, as long as the resulting pixel period reduces or prevents meniscus instability. This has the consequence that the adjusted holding period in successive actuating element signals may be variable. Thus, in a general sense, the provision of a jitter delay value may shorten (or extend) a pixel period and extend (or shorten) a subsequent second pixel period, such that neither the first nor the subsequent pixel period falls within the dataset of forbidden pixel periods that cause harmonic/subharmonic excitation of the meniscus surface and lead to meniscus instability.

The holding period 243 may be defined as a period during which the signal applied to the actuating element does not cause ejection of a droplet. It could purely be the baseline voltage applied to the actuating element, or it might comprise small non-ejecting pulses used for conditioning the actuating element, fluid chamber or meniscus.

The above example shows, for simplicity, a binary printing case. In greyscale applications, gradations in pixel density are achieved by printing a variable volume of ink into pixels. This may be done by choosing a different number of otherwise identical drive pulses per pixel, depositing different numbers of droplets into different pixels, or by altering the shape of the actuating element signal, depositing different sized droplets into different pixels, or a combination of both. In this case, the pixel period is the period determined by the first drive pulse, respectively, of consecutive actuating element signals. The above examples described with respect to FIGS. 5B and 5C therefore apply equally to more than one drive pulse per actuating element signal, where the first drive pulse within the same actuating element signal defines the start of the pixel period, and the first drive pulse in the next actuating element signal defines the end of the period of the actuating element signal.

FIGS. 5B and 5C illustrate how one pixel period may be adjusted in relation to at least one of the neighbouring two pixel periods so as to fall outside a dataset of forbidden pixel periods. More generally, the pixel line periods of consecutive actuating element signals 721_*n* having at least one drive pulse 242 may be adjusted by respective jitter delay values Jn such that none of the pixel line periods assume a value that falls within the data set of forbidden pixel periods.

Therefore, where the second print data further comprises data defining a second holding period, in certain embodiments the method by which a first jitter delay value adjusts the first pixel period to fall outside of the set of forbidden pixel periods further comprises the steps of: (a) receiving a third data block for a third line pixel; and (b) generating third print data based on the third data block, wherein the third print data comprises data defining one or more drive pulses, the time between each first of the one or more drive pulses defined by the second and third print data determines a second pixel period, and the second pixel period is adjusted by the first jitter delay value to fall outside the data set of forbidden pixel periods.

Furthermore, the method may, additionally or instead, comprise the steps of (a) receiving a third data block for a third line pixel; (b) determining a second jitter delay value based on the data set of forbidden pixel periods and optionally on the first jitter delay value, wherein the second print data 241_2 further comprises data defining a second holding period 243_2 determined by the second jitter delay value and optionally the first jitter delay value; (c) generating third print data 241_3 based on the third data block, wherein the third print data comprises data defining one or more drive pulses 242, and the time between each first of the one or more drive pulses defined by the second and third print data 241_2, 241_3 determines a second pixel period. The second pixel period is adjusted by the second jitter delay value and optionally the first jitter delay value to fall outside the data set of forbidden pixel periods.

Theory

Figure 2B:
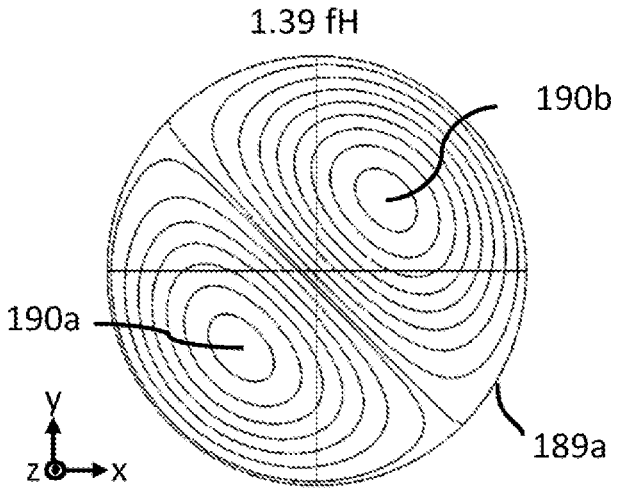
FIG. 2B is one example of a theoretical profile plot of the meniscus surface as a result of droplet ejection by an actuating element signal having a forbidden period.

Without being bound by any particular theory, the inventors consider plausible that the ejection of alternately opposite droplet deviations is caused by harmonics and subharmonics of the meniscus resonant mode. FIG. 2B shows a 3-dimensional representation of the meniscus surface 190 within the nozzle 189*a* while the droplet deposition apparatus operates within a "forbidden" range of frequencies corresponding to the simplest one of the harmonic modes. As can be seen in FIG. 2B, the meniscus surface 190 represented by contour lines no longer has a central peak (or trough, depending on the progression of the drive pulse) as shown for normal behaviour in FIG. 1B. Instead, a peak 190*b* and trough 190*a* coexist side by side. This may be expected to lead to off-axis droplet ejection, and plausibly to the alternate opposing droplet deviation of FIG. 2B as the profile oscillates such that the peak 190*b* becomes a trough and the trough 190*a* becomes a peak. It is presumed that at certain pulse frequencies, the periodic arrival of acoustic pressure waves at the nozzle can cause an unpredictable and uncontrollable surface profile, or "nozzle meniscus instability", that in turn causes uncontrollable droplet placement. It is thought that such behaviour in the meniscus is caused by meniscus resonance generated by successive drive pulses of different pixel line signals that fall within the resonance band of the nozzle geometry.

The harmonic mode represented in FIG. 2B may not be the only harmonic mode generated as a result of applying drive pulses within a certain 'forbidden' frequency band. Other harmonics with a different number of maxima and/or minima may significantly affect the meniscus profile and therefore droplet placement.

One way to determine the 'forbidden' or 'excluded' range of frequencies may be to analyse the meniscus instability as a function of pixel line frequency. To achieve this by way of simulation, a parameter of meniscus instability (PMI) may be defined which correlates the displacement of the meniscus' centre of mass with the meniscus harmonics, i.e. the larger the displacement of the meniscus' centre of mass, the larger the PMI. The PMI may be determined by calculating the displacement of the meniscus' centre of mass in relation to the nozzle centre such that the $PMI=\sqrt{(x^2+y^2)}$, where x and y are coordinates of the centre of mass across the meniscus.

Figure 3:
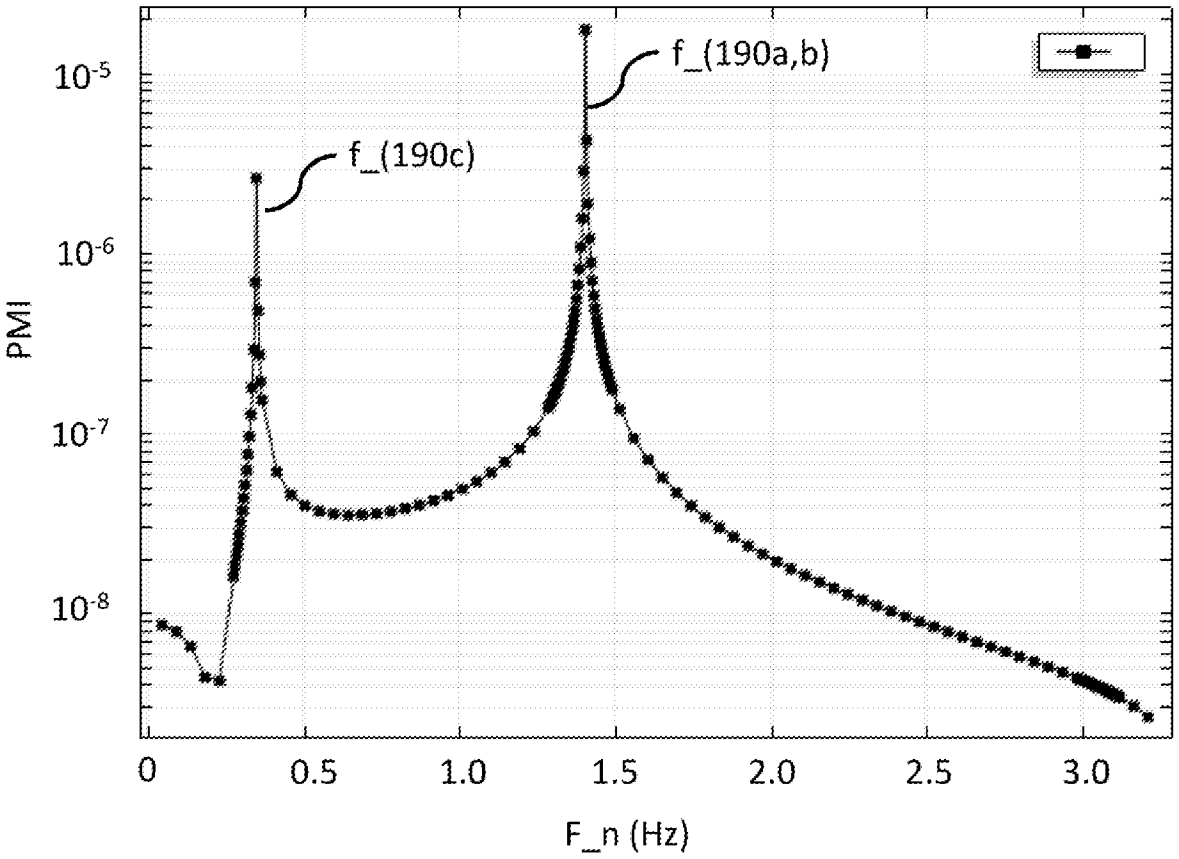
FIG. 3 is a graph of the parameter of meniscus instability versus normalised pixel frequency based on simulations.

FIG. 3 shows an example of the relation between the PMI and pixel line frequency. In this representation, the specific range around the first harmonic f_(190*a,b*) and the 4th subharmonic f_(190*c*) for the nozzle geometry was assessed. Other subharmonic orders may cause a significant PMI peak, however these were not assessed in detail in this case.

The x-axis of FIG. 3 is normalised against the Helmholtz frequency, $f_H$, of the fluid chamber, and the frequencies causing the peaks in PMI are f_(190*a,b*)=$1.39f_H$ and f_(190*c*)≈$0.35f_H$. Relating to a real example of a printhead designed to print at a target pixel line frequency of up to or more than 100 kHz, and having a Helmholtz frequency of 220 kHz, it can be seen that a significant PMI peak exists at around 306 kHz.

Without being bound by any particular theory, it is considered that the peak at f_(190*c*) has at least one component which is a subharmonic of the peak at f_(190*a,b*). Since f_(190*c*)=¼×f_(190*a,b*), it is assumed that at least one component of the frequency f_(190*c*) is the fourth subharmonic of f_(190*a,b*). Therefore, FIG. 3 suggests that the when printing within the excluded range around f_(190*c*), the droplet deviation is caused by the superposition of the harmonic mode at f_(109*a,b*) with the normal jetting mode of the meniscus.

It is expected that an empirical analysis of the phenomenon will show a broader spread in peaks due to manufacturing variability of the nozzle, and, specifically for a whole printhead, the resonant modes, and consequently the subharmonic modes, will be spread across a broader range of frequencies centred around the peak frequency.

Based on this explanation, it can be seen how ensuring that printing at pixel periods outside of the data set of forbidden pixel periods will reduce or even prevent the occurrence of meniscus instability due to harmonic/subharmonic excitation of the meniscus surface, and how suitable selection and application of a jitter delay value to extend or shorten a normal pixel period so that it falls outside of this data set may be employed to achieve it.

Further Implementations of the Method

There are several ways of choosing the jitter delay values such that, between consecutive actuating element signals 721, the pixel period is varied. For example, the first and second jitter delay values, respectively determining the first and second holding periods in the corresponding first and second consecutive actuating element signals, can be chosen to provide first and second pixel periods outside the data set of forbidden pixel periods.

For example, the data set of forbidden frequencies may comprise a range of forbidden frequencies of 71-79 kHz. The first pixel period $\tau_1$ that would otherwise fall within the forbidden range may be adjusted by a jitter delay value J1 so that it assumes the value of 70 kHz, while the second pixel period $\tau_2$ may also be adjusted by J1 so that it becomes 80 kHz and also does not fall within the forbidden range.

Similarly, the first pixel period $\tau_1$ that would otherwise fall within the forbidden range may be adjusted by a jitter delay value J1 so that it assumes the value of 68 kHz, while the second pixel period $\tau_2$ that would otherwise also fall within the forbidden range may be adjusted by a jitter delay value J2 so that it assumes the value of 70 kHz.

In another example, the first pixel period $\tau_1$ that would otherwise fall within the forbidden range may be adjusted by a jitter delay value J1 so that it assumes the value of 70 kHz, while the second pixel period $\tau_2$ that would otherwise also fall within the forbidden range may be adjusted by a jitter delay value J2 so that it assumes the value of 80 kHz.

Therefore, in such embodiments, the first jitter delay values may be chosen to provide first and second pixel periods to fall on opposite sides of the data set of forbidden pixel periods. Alternatively, the first jitter delay values may be chosen to adjust one of the first and second pixel periods to fall outside the data set of forbidden pixel periods.

In some cases it may be possible to allow a single period to fall within but near the ends of the forbidden range without causing significant meniscus instability. For example, the first pixel period $\tau_1$ that would otherwise fall within the forbidden range may be adjusted by a jitter delay value J1 so that it assumes the value of 70 kHz, while the second pixel period $\tau_2$ may either be adjusted to fall just within the forbidden range or allowed to fall just within the forbidden range, to assume or have the value of e.g. 72 kHz. This may still provide some reduction in meniscus instability while avoiding too large a change in period between consecutive pixels. Preferably, $\tau_2$ avoids the period that defines the peak of the meniscus instability.

It is not essential that $\tau_2$ is the period that falls inside the forbidden range. Instead, $\tau_1$ may be allowed to fall within the forbidden range, to assume e.g. a value of 72 kHz, while $\tau_2$ is adjusted to assume a value outside the forbidden range, e.g. 80 kHz.

Therefore, in such cases, at least one of the first and second jitter delay values may be chosen to provide at least one of the first and second pixel periods inside the data set of forbidden pixel periods.

In cases where the relative speed between the printhead and the media has achieved a constant value, the pixel line has a constant length in the printing direction, and the pixel period is chosen to ensure that the actuating element signal is timed with respect to the media speed. During acceleration or deceleration, however, the pixel period contracts/extends in response to the media encoder signal. In other words, in an ideal situation the pixel period matches the duration that the pixel length passes underneath the printhead. When jitter is applied as the ideally required pixel period passes through a range of forbidden pixel periods, the pixel period is forced to be different to the length of the pixel period (the "media pixel period"). The specific method that may be applied to reduce the meniscus instability, based on the options outlined above, will depend on whether a large jump in pixel period from one pixel to the next results in a visual artefact.

Therefore, the above methods may further comprise the step of determining a first media pixel period by the media encoder circuitry 310; wherein the first jitter delay value is chosen to provide a first pixel period such that the first pixel period does not match the media pixel period determined by the media encoder 30.

Furthermore, the first and second jitter delay values may be chosen to provide a second pixel period such that the second pixel period does not match the media pixel period determined by the media encoder 30.

More generally, in the above methods, for a plurality of print data that comprise the first and second print data, each of the plurality of print data may comprise data defining at least one first drive pulse, successive first drive pulses define respective pixel periods, and a plurality of jitter delay values comprising the first jitter delay value may be chosen such that over a print duration portion corresponding to the plurality of print data, the average pixel period defined by the plurality of print data may match the average of a plurality of corresponding media pixel periods that occur over the print duration.

For example, Table 1 shows a series of linearly increasing media pixel periods in kHz, changing over 8 pixel periods from 68 to 82 kHz over a print duration portion as the media speeds up relative to the printhead. Meanwhile the pixel period (i.e. the period of the actuating element signals as defined by data of the print data) is adjusted for some of the pixels by respective jitter delay values, so as to avoid pixel periods from falling within a range of forbidden pixel periods of 71-79 kHz. The pixel period is the same as the media pixel period for the first two and the last two pixels, since for these the media pixel period falls outside of the forbidden range. For pixels 3-6 however, the pixel period is adjusted as it would otherwise fall within the forbidden range if it were allowed to match the media pixel period. As one example, the pixel period is adjusted to 70 or 80 kHz for these pixels. For pixels 3 and 4, to achieve a lower frequency the pixel period is extended by a suitable jitter delay value, for example by a positive value that delays the start of the next actuating element signal. For pixels 5 and 6, the pixel period is shortened by another suitable jitter delay value, for example by a negative value that causes the next actuating element signal to start early, as will be discussed below. On average, the media pixel period and the pixel period are the same at 75 kHz over the 8 pixels. In other words, while the printed pixels are condensed or stretched on the media, the start and finish time of pixels 1 to 8 on the media passing under the printhead and the media being printed on is the same.

TABLE 1

| | Pixel Number: | | | | | | | | Average, |
|---|---|---|---|---|---|---|---|---|---|
| | 1 | 2 | 3 | 4 | 5 | 6 | 7 | 8 | kHz |
| Pixel frequency (kHz) | 68 | 70 | 70 | 70 | 80 | 80 | 80 | 82 | 75 |
| Media pixel frequency (kHz) | 68 | 70 | 72 | 74 | 76 | 78 | 80 | 82 | 75 |

In one implementation of the above method, at least one of the jitter delay values may be chosen to provide at least one of the pixel periods to fall outside the data set of forbidden pixel periods. In some droplet deposition apparatus, a small number of pixel periods falling within the data set of forbidden pixel periods may be tolerated before the meniscus instability causes appreciable droplet deviation. For example, this may be due to different degrees of fluidic damping within different apparatus. In some apparatus however, preferably all pixel periods are adjusted to fall outside the data set of forbidden pixel periods.

In another implementation of the above method, at least one of the jitter delay values is chosen to cause at least one of the pixel periods to fall at either side of the data set of forbidden pixel periods. To ensure the smallest difference between pixel periods, the jitter delay value(s) may be chosen to provide consecutive pixel periods at either side of the data set of forbidden pixel periods.

In another implementation of the above method, at least one of the jitter delay values may be chosen to cause at least one of the pixel periods to fall within the data set of forbidden pixel periods. It may further be possible to select jitter delay values so as to cause consecutive pixel periods to fall within the data set of forbidden pixel periods, as long as the pixel periods are not the same.

Returning to the conceptual illustration of FIG. 3, it is further possible that some geometries can tolerate pixel periods that fall within the lower slopes of the peak at f_(190*c*), while others need to avoid it altogether.

In all the methods described herein, the data set of forbidden pixel periods may correspond to a range of harmonic and/or subharmonic frequencies relating to the nozzle. Based on the geometry and dimensions of the nozzle and pressure chamber, these may excite instabilities of the meniscus.

It is expected that the dataset of forbidden pixel periods is unique to a specific fluid chamber/nozzle geometry and dependent on the Helmholtz frequency of a given system.

Additionally, the properties of the printhead will determine the pixel period range that may be accessed. For example, the first harmonic may occur at a relatively high frequency (e.g. around 306 kHz), which may not be accessible by present printheads. Instead, only a subharmonic frequency, such as the 4th and higher subharmonic, and/or the 5th subharmonic, may fall within the currently accessible pixel period (print frequency) range. It may only be the 4th subharmonic (or another order of subharmonics, or more than one order) that causes droplet deviation significant enough to warrant defining a forbidden range within the forbidden data set, such that in all of the above methods, the data set of forbidden pixel periods may correspond to the fourth subharmonic frequency that may be excited on the meniscus surface of the nozzle. In other cases, the data set may include several forbidden ranges or values. The data set may further include pixel periods that correspond to the third or fifth subharmonic frequencies.

The specific data set may be defined empirically for a given printhead. For example, for a fluid chamber and nozzle geometry for which $f_H$=220 kHz, for the above methods described, the dataset of forbidden pixel periods may include a range that corresponds to 71-79 kHz. When printing at this frequency band, the droplet anomaly of forking may be observed. Moreover, the data set of forbidden pixel periods may further include a range that corresponds to 47-53 kHz (an example of a fifth subharmonic) or 98-106 kHz (an example of a third subharmonic). When printing at this frequency band, the droplet anomaly of missing drops in alternate pixel lines may be observed.

Considerations of Positive and Negative Jitter Values and Relation to Virtual Pixel Clock Following on from the description of FIG. 5B, the triggers VPCLKn may be used, e.g. as part of the print data 241, to define the timing for generating corresponding actuating element signals 721. In more detail, the first trigger VPCLK1 may be used to define the timing for generating the first actuating element signal 721_1. The second trigger VPCLK2 of the pixel clock may be used to define the timing for generating the second actuating element signal 721_2 after expiry of the holding period 243_1 adjusted by the first jitter delay value J1. The second actuating element signal 721_2 then controls the actuating element 110 according to the second data block 2_2. Next, the third trigger VPCLK3 of the pixel clock may be used to define the timing for generating the third actuating element signal 721_3 after expiry of the holding period 243_2 adjusted by the second jitter delay value J2 to control the actuating element 110 according to the third data block 2_3. FIGS. 5B and 5C show that the jitter delay value applied to one pixel period $\Delta t_1$ may be used to also adjust the pixel period of the adjacent actuating element signal. Therefore, avoiding a forbidden pixel period (and adjusting a preceding, or consecutive, period, if necessary) may be achieved by applying one jitter delay value J1.

The above discussion describes the use of positive and negative jitter delay values. In some cases it may be preferable to only apply positive jitter delay values, for the following reason. Positive jitter delay values can be applied upon a pixel clock trigger, which is a 'past' event. However, negative jitter delay values need to be applied before a pixel clock trigger, i.e. before the trigger has happened. In practice, it is preferable to apply a jitter delay value to a trigger once the trigger has occurred, rather than before. In this case a set comprising negative jitter delay values may be converted to purely positive jitter delay values as follows.

Starting from a set J1-J5 comprising negative jitter delay values, Jn, determined by e.g. the processing circuitry 220 for a specific actuating element signal sequence 721_1 to 721_5, the most negative jitter delay value $Jn_{min}$ is identified. This is exemplified in Table 2. For each actuating element signal 721_1-5, a jitter delay value is determined, and the most negative value is −1.5 for actuating element signal 721_5.

TABLE 2

| Actuating element signal | Jn (μs) | Jn' (μs) = Jn + $\lvert Jn_{min}\rvert$ |
|---|---|---|
| 721_1 | +1.0 | +2.5 |
| 721_2 | +0.5 | +2.0 |
| 721_3 | −0.5 | +1.0 |
| 721_4 | +1.5 | +3.0 |
| 721_5 | −1.5 ($Jn_{min}$) | 0 |

Figure 6:
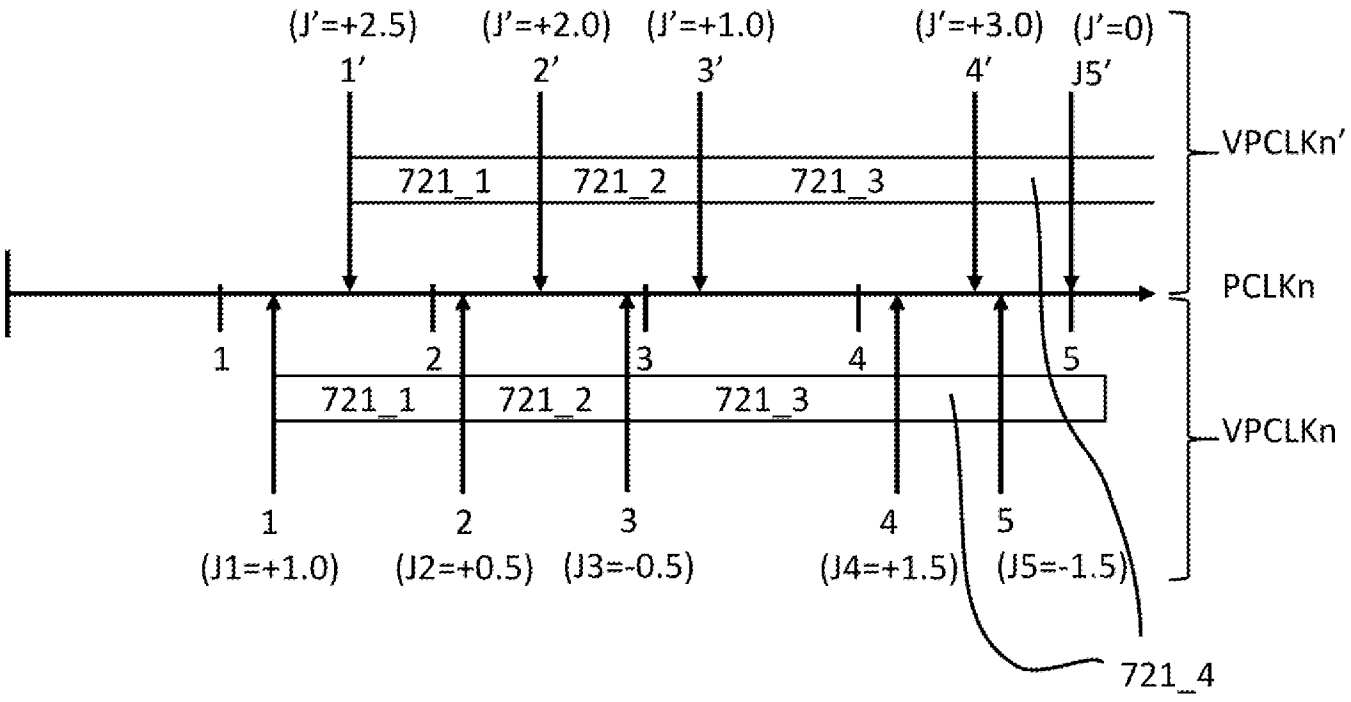
FIG. 6 shows virtual pixel clock signals adjusted by purely positive jitter delay values based on a combination of positive and negative initial jitter delay values.

Next, all jitter delay values Jn are shifted by the modulus of the most negative value of Jn, $\lvert Jn_{min}\rvert$, in this case $\lvert Jn_{min}\rvert$1.5, by adding $\lvert Jn_{min}\rvert$ to all values of Jn. This results in a transposed set Jn', i.e. $Jn'=Jn+\lvert Jn_{min}\rvert$. $Jn_{min}$ is transposed to 0, and for all other transposed values $Jn'\geq 0$. This is further illustrated in FIG. 6. FIG. 6 illustrates virtual pixel clock triggers VPCLKn relating to actuating element signals 721_1 to 721_5. Actuating element signals 721_1 to 721_5 comprise at least one holding period determined by a negative jitter delay value. With respect to the pixel clock signal PCLK, virtual pixel clock triggers VPLCKn modified by positive and negative jitter delay values J1-J5 are defined, indicating their position on the pixel clock timeline. The transposed set Jn' transposes modified pixel clock triggers to transposed pixel clock triggers VPLCKn' as indicated above the pixel clock timeline. It can be seen that, with respect to the initial set of locations VPLCKn along the pixel clock, the transposed pixel clock triggers VPLCKn' are simply delayed as a whole by the modulus of the most negative jitter delay value of the jitter delay values Jn. Therefore the transposed set of jitter delay values Jn' may be used to define the transposed virtual pixel clock triggers VPCLKn'. The transposed set of pixel clock values may then be used by the print data generation circuitry 240 to determine some of the timing data in the print data. Therefore, for actuating element signals **721_*n***, in effect, only positive jitter delay values are applied.

Other timing considerations can be made where jitter is applied to an actuating element signal. In general, in the binary case, the holding period may be determined by the duration of the pixel period minus the duration of the drive pulse. In theory, therefore, the next actuating element signal may be applied as soon as the present drive pulse has been applied, at the start of the holding period, i.e. the jitter applied would be a negative jitter of the duration of the previous holding period. In practice, it is possible that the data block for the next actuating element signal has not yet been received at the start of the holding period. For example, the print data for the next pixel may only be sent upon completion of the present drive pulse 242 and is only received by the droplet deposition apparatus upon expiry of a print data loading duration. The print data loading duration may be significant with respect to the actuating element signal (i.e. the pixel period) and therefore may limit the shortest holding period that is possible, and therefore also the earliest time to which the next actuating element signal may be advanced, for example by application of a negative jitter value to the present holding period. This may especially the case where the print data relates to more than one actuating element.

Figure 7:
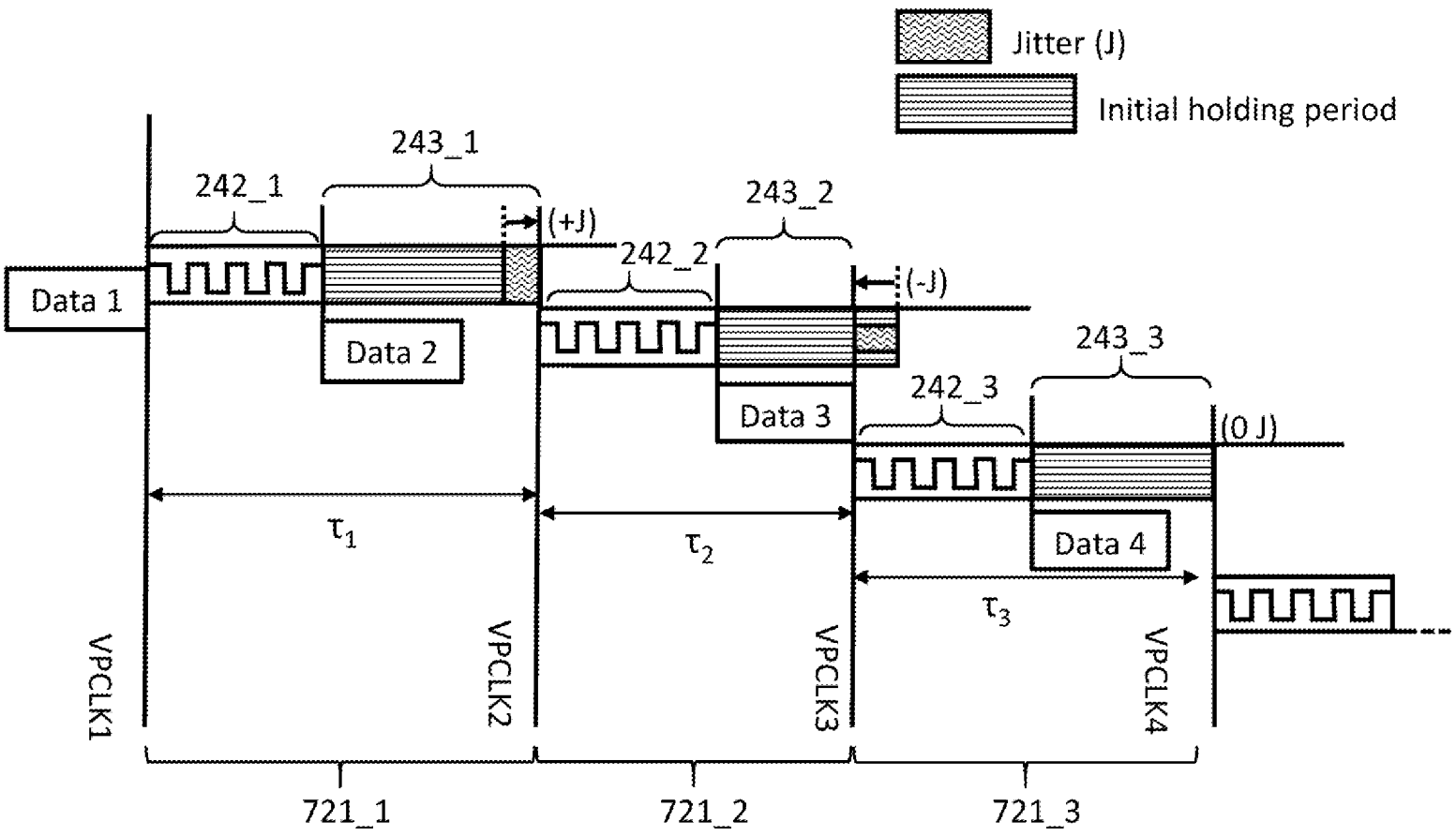
FIG. 7 is an illustration of an actuating element signal sequence with jitter delay and data load timings.

With reference to FIG. 7, the effect of the duration of print data (DATA) loading on the holding period is illustrated. While in FIG. 7 the triggers to generate the actuating element signals are shown as virtual pixel clock triggers for convenience, in practice they may be provided as part of the timing data of print data DATA. In comparison to previous Figures, FIG. 7 shows a greyscale example of multiple drive pulses applied per actuating element signal 721.

DATAn for an nth actuating element signal is sent from the print data generating circuit 240 to the head control circuitry 720, which generates actuating signals 721 for the actuating element 110. Drive pulses 242_1 are applied upon a trigger VPCLK1 of the virtual pixel clock. In this case, first print data, DATA1, based on data block 2_1, has already been received. Upon completion of pixel pulses 242, second print data, DATA2, based on data block 2_2, begins to load and is received fully before completion of the holding period 243_1 of the first actuating element signal 721_1. A positive jitter delay value is used to extend the initial holding period to the holding period 243_1. In FIG. 7 the initial holding period is of a constant duration as indicated by the constant sized horizontally lined block. The jitter delay value is indicated by the block filled with wavy lines and applied to the initial holding period according to its sign. Furthermore, FIG. 7 illustrates a sequence of four drive pulses per actuating element signal. The holding period **243_*n***, whether modified by a jitter delay value or not, in each case needs to be long enough to match the duration of data load so that the subsequent actuating element signal may be correctly generated.

Therefore the initial holding period may need to allow for a data load duration and the duration of the modulus of the most negative jitter delay period applicable, such that the holding period 243_min is defined by the modulus of the most negative jitter value of the sequence of actuating element signals 721 plus the data load duration. As may be seen for pixel period $\tau_2$ of actuating element signal 721_2, the initial holding period is modified by a negative jitter delay value to become holding period 243_2, which advances the next virtual pixel clock trigger, VPCLK3, to the end of the minimum possible holding period as determined by the loading period and the negative jitter value. Therefore, with the above implementations for print data for an actuating element signal and defining a holding period determined by a corresponding jitter delay value, the holding period may further be defined to have a duration at least as long as a data load duration for sending subsequent print data for a subsequent actuating element signal. The duration is the time elapsed between the print data being sent by the droplet data generation circuitry and it being received by the head control circuitry, for example, and being available for generating the corresponding actuating element signal.

In a variation to the example shown in FIG. 7, the holding period 243 may be variable further than by the application of jitter, since it is the period from the last drive pulse of a first actuating element signal to the first drive pulse of the second actuating element signal. For example, if the first actuating element signal 721_1 only applied the first two drive pulses of the four shown, and the holding period 243_1 were to start directly after the second drive pulse, potential scenarios may include:

- the holding period and jitter remain as shown and are unadjusted, such that the period of the actuating element signal 721_1 is shortened. In some implementations this may mean that the 'missing' two pulses present a contribution having the same effect as a negative jitter delay value, and may be taken into account when determining the jitter delay value for an actuating element signal not applying the full number of drive pulses.
- the holding period is adjusted by a modified jitter delay value that extends the initial holding period, such that the period of the actuating element signal 721_1 remains the same as if four drive pulses had been applied. In this case, the duration of the two 'missing' pixel pulses is replaced by a corresponding addition to the jitter delay duration to compensate.

In some droplet deposition apparatus, in such scenarios it may be possible to start new data load as soon as the last of the drive pulses during an actuating element signal has been applied and the holding period begins, for example in 'hot switch' implementations where each individual drive signal for each actuating element is generated actively.

In some droplet deposition apparatus utilising elements of 'cold switching' however, the individual actuating element signals for several actuating elements may be based on a common drive waveform (CDW). In such implementations, a maximum number of required drive pulses per pixel are provided, for example based on image data or based on the capability of the controller 20. All, some, or none of the pulses of the CDW may be used, based on the print data, to generate drive pulses in the actuating element signals. For example, eight drive pulses may be provided in the common waveform to all actuating elements, however only the first three have a corresponding timing signal in the print data and are generated as drive pulses in the actuating element signal. The remaining five drive pulses provided by the common waveform receive are not used. After the third drive pulse, the actuating element signal may remain at base level voltage. While this in principle may be perceived as presenting part of a variable holding period, in some cold switch implementations no data load may be performed until the duration of all potential drive pulses in the common drive waveform has expired.

In other implementations such as hot switch implementations, data load straight after generation of the last drive pulse is possible, and this additional period may be considered as part of the variable holding period.

The set of jitter delay values may be predetermined and analysed for the entire duration of acceleration or deceleration of the printhead relative to the media, since during this time the pixel period (actuating element signal period) continuously changes. The most negative jitter delay value for all actuating element signals for the duration of acceleration/deceleration may be determined to ensure a minimum initial holding period is defined when generating the print data, such that a sufficiently long holding period 243 can be provided in each actuating element signal 721 to ensure that the relevant print data can always be received in time before the trigger to generate the next actuating element signal 721.

As has been described in relation to FIGS. 5A to FIG. 7, in some instances, the first jitter delay value may be a positive value. This means that the jitter delay value extends the holding period 243 of the first actuating element signal 721. It may further shorten the holding period of the subsequent actuating element signal 721.

In other instances, the jitter delay value may be a negative value. This means that the jitter delay value shortens the holding period 243 of the first actuating element signal. It may further extend the holding period 243 of the subsequent actuating element signal 721.

Where the first jitter delay value is a negative value, the above methods may optionally also comprise the steps of determining a virtual pixel clock based on the media pixel period determined by the media encoder circuitry 310, the virtual pixel clock comprising a plurality of virtual triggers; and determining a transposed virtual pixel clock transposed from the virtual pixel clock by the modulus of the first jitter delay value, where the transposed virtual pixel clock comprises a plurality of transposed virtual triggers. The first and second print data 241 are generated based further on the transposed virtual triggers of the transposed virtual pixel clock so as to define holding periods 243 determined only by positive jitter delay values.

Where a second jitter delay value has been determined for a second actuating element signal 721, and the second jitter delay value is also negative, the transposed virtual pixel clock is transposed from the virtual pixel clock by the maximum value of the moduli of the first and second jitter delay values.

In some implementations, the first print data may define the first holding period such that the first holding period is extended by the first jitter delay value if the first jitter delay value is positive. Alternatively the first print data may define the first holding period such that the first holding period is shortened by the first jitter delay value if the first jitter delay value is negative.

General Considerations

In all of the above-described methods and variants, the step of receiving a first, second or more data blocks for a first, second or more line pixels, and the step of receiving a data set of forbidden pixel periods may further include the step of receiving a media encoder input, wherein the jitter delay value based on the data set of forbidden pixel periods is further based on the media encoder input. The media encoder input may be converted by the media encoder circuitry into media pixel periods. The media encoder input may further be adjusted to generate a virtual pixel clock that takes into account variations and errors in the pixel clock, and virtual pixel clock triggers are generated from the virtual pixel clock that are the triggers used to send the actuating element signals to the actuating element(s). From an assessment of the values of the virtual pixel periods and the data set of forbidden pixel periods, the jitter delay values may be determined so as to ensure that all or most (e.g. at least 70%, preferably at least 80%, and more preferably at least 90%) of the periods of the actuating element signals fall outside of the data set of forbidden pixel periods.

Furthermore, all of the above-described methods and variants may be applied during acceleration or deceleration of the printhead relative to the media. Specifically, the first and second print data may be generated to correspond to a duration of acceleration or deceleration of the relative motion between a printhead of the droplet deposition apparatus, wherein the first jitter delay value adjusts the first pixel period to fall outside of the data set of forbidden pixel periods so as to reduce the occurrence of nozzle meniscus instability.

Regarding the drive pulses, for all of the above-described methods and variants the shape of each drive pulse in each or between different actuating element signals may be the same, or it may be different. For example, the shape of the drive pulse may be rectangular, sinusoidal, or triangular, or any other suitable shape. Whether the shape of the first drive pulse in each actuating element signal is the same or different, the period of the actuating element signal is determined by the first drive pulse between successive actuating element signals respectively, regardless of shape.

The above-described methods and variants may be particularly effective where the second line pixel follows immediately the first line pixel.

In some implementations, some actuating element signals may comprise more than one drive pulse, and a jitter delay value may be applied to periods defined by combinations of the more than one drive pulses that may be comprised in successive pixel periods. For example, where the duration between the first drive pulse of a first pixel and the second drive pulse of a second pixel represents a period that falls within the data set of forbidden pixel periods, a jitter delay value may be applied between these two drive pulses so as to adjust the duration to represent a period that falls outside the data set of forbidden pixel periods. In some implementations, a jitter delay value may be applied to all drive pulses in an actuating element signal.

With reference to the actuating element 110 controlled by actuating element signals 721, other designs of actuating element 110 or actuator 100 are possible as the specific type is not essential. Additionally, even though the actuator 100 of FIG. 1 shows one actuating element 110, the actuator may comprise a plurality of actuating elements adjacent 110 to a corresponding plurality of fluid chambers each having a respective nozzle. Alternatively, two or more actuating elements may be provided for each nozzle to cause ejection. Further, it is not essential that the actuating element is located at a roof of the pressure chamber, or that the nozzle is located within the pressure chamber. A similar consideration as those discussed herein may apply to nozzles in fluidic communication with a pressure chamber via an intermediate fluid path.

More Detail In Respect of the Controller

The above-described methods and variants may be applied in various ways using one or more components of the droplet deposition apparatus 1. Referring back to FIG. 4, the droplet deposition apparatus 1 comprises a printhead 70 having actuating element 110, and further comprises a controller 20. In the illustrated embodiment, the controller 20 includes processing circuitry 220 configured to receive a data block 2 from image processing circuitry (not shown) for a specific pixel line, based on image data. The processing circuitry 220 is further configured to receive and a data set of forbidden pixel values 3 based on the properties of the printhead. For a greyscale image, data blocks 2 may determine the number of droplets required for each media pixel.

Jitter generation circuitry 210 comprised within the processing circuitry 220 is arranged to provide a jitter delay value based on the data set of forbidden pixel periods 3. Specifically, and with reference to FIGS. 5B and 5C, the controller 20 includes processing circuitry 220 configured to carry out the steps of: receiving first and second data blocks 2_1 and 2_2 and the data set 3 of forbidden pixel periods, for example comprising a forbidden pixel period 3_1; and determining a first jitter delay value J1 based on the data set of forbidden pixel periods 3, for example based on the forbidden pixel period 3_1.

To implement the method of FIG. 5B, the processing circuity 220 is configured to determine a jitter delay value J1 that may be used to extend a holding period 243_1 of an actuating element signal 721_1, where the holding period 243_1 follows a drive pulse 242_1 comprised within the actuating element signal 721_1. In the case of the implementation of FIG. 5C, the processing circuity 220 is configured to determine a jitter delay value J1 that may be used to shorten a holding period 243_1 of an actuating element signal 721_1, where the holding period 243_1 follows a drive pulse 242_1 comprised within the actuating element signal 721_1. The step of determining a jitter delay value J1 may be carried out by jitter generation circuitry 210 comprised within the processing circuitry 220. The jitter generation circuitry 210 may further adjust a virtual pixel clock based on jitter delay values such as J1 and define virtual pixel clock triggers that determine when to provide the actuating element signals to the actuating element(s).

As discussed previously, the media encoder 30 generates the media encoder input 31 and sends it to media encoder circuitry 310. The media encoder input 31 contains data relating to the characteristics of the medium, such as the speed (or change in speed) of the medium moving in relation to the droplet deposition apparatus 1, and/or the speed (or change in speed) of the droplet deposition apparatus 1 moving in relation to the medium. If the speed of the medium changes—if it slows down or speeds up—the media encoder 30 updates the media encoder input 31 accordingly.

The media encoder circuitry 310 may process the media encoder input 31 to determine the timing of ejection of the droplets in the form of virtual pixel clock triggers VPCLKn so as to accurately fill the pixels on the media. This information is then conveyed to the processing circuitry 220 by means of the media encoder signal 311. As such, the media pixel period may be determined by the media encoder circuitry 310 based on the media encoder input 31. However, as discussed above, when determining a jitter delay value J to adjust the pixel period $\tau$ of the actuating element signal 721, the adjusted pixel period may not match the media pixel period determined by the media encoder, so as to adjust the pixel period $\tau$ to fall outside of the range of forbidden pixel periods.

The processing circuitry 220 includes jitter generation circuitry 210 configured to determine jitter delay values based on the data set 3 of forbidden pixel periods, and to generate a control signal 221 comprising modified virtual pixel clock triggers based on a virtual pixel clock and the jitter delay values. The jitter delay values serve to adjust certain pixel periods, by adjusting the virtual pixel clock, to fall outside of the data set 3 of forbidden pixel periods, so as to reduce the occurrence of nozzle meniscus instability. The control signal 221 is sent to the print data generating circuit 240 configured to generate print data 241 based on the data blocks 2 and based on the virtual pixel clock triggers as adjusted by the jitter delay values. The print data generating circuit 240 is further configured to send the print data 241 to the head processing circuitry 720. The head processing circuitry 720 is located in the printhead 70 and is configured to generate actuating element signals 721 based on the print data 241 to control at least one of the actuating elements 110.

The generation of the actuating element pulses may be carried out differently. Above, the controller 20 provides only print data based on data blocks and virtual pixel clock triggers. This data may comprise all the information necessary for the head control circuitry to generate the actuating element signals. Alternatively, the print data 241 may be sent in parallel with a waveform signal 245 of a common drive waveform that is common to more than one actuating element 110.

In this case, the processing circuitry 220 is configured to receive from the media encoder circuitry 310 a set of virtual pixel clock triggers as part of signal 311. These virtual pixel clock triggers are adjusted based on jitter delay values and provided as part of control signal 221 to the print data generation circuitry 240.

The print data generation circuitry 240 is configured to generate a stream of print data 241 for actuating element timing signals 721. The print data 241 comprise data that allows the timing data for each actuating element 110 and line pixel to be identified, and is based on the virtual pixel clock triggers VPCLKn and the data blocks 2. The stream of print data 241 determines when each actuating element 110 is to receive a pulse from the common drive waveform. The print data generation circuitry 240 is further configured to provide the print data 241 to the head control circuitry 720 of printhead 70.

The common drive waveform signal 245 is generated by waveform generator 250 of the processing circuitry 220 based on data blocks 2. For a greyscale image, data blocks 2 from image processing circuitry (not shown) may determine the number of droplets required for each media pixel. The waveform generator 250 is configured to generate a common drive waveform stream 245 based on the maximum number of droplets required per pixel according to data blocks 2 as required for the image, so that the common drive waveform provides a sufficient number of pulses that may be used to generate a sufficient number of drive pulses to deposit the corresponding maximum number of droplets per media pixel. The common drive waveform further comprises an initial holding period.

The waveform generator is configured to send the common drive waveform signal 245 to the head control circuitry 720.

The head control circuitry 720 comprises a set of switches corresponding to each actuating element 110 and is configured to switch the common drive waveform stream 245 in and out of a specific actuating element 110 based on corresponding print data supplied as part of print data 241.

With respect to FIGS. 5B and 5C for example, the print data generating circuit 240 is configured to carry out the steps of: generating first print data 241_1 based on the first data block 2_1 and the first jitter delay value J1 (in this case via the virtual pixel clock VLPCKn adjusted by J1) so as to adjust at least the first pixel period $\tau_1$ to fall outside of the dataset of forbidden pixel periods; generating second print data 241_2 based on the second data block 2_2; and sending the first and second print data 241_1 and 241_2 to control the at least one actuating element 110 of the droplet deposition apparatus 1 according to the first and second data blocks 2_1 and 2_2.

Additionally, the print data generating circuit 240 may be configured to generate the second print data 241_2 further based on the first jitter delay value J1 so as to adjust the second pixel period $\tau_2$ to fall outside of the dataset of forbidden pixel periods. To this end, the processing circuitry 220 of the controller 20 may receive a third data block 2_3, and the print data generating circuit 240 may be configured to carry out the steps of: generating third print data 241_3 based on a third data block 2_3, wherein the third print data comprises data defining one or more drive pulses, the time between each first of the one or more drive pulses defined by the second and third print data determines a second pixel period, and the second pixel period $\tau_2$ is adjusted by the first jitter delay value to fall outside the data set of forbidden pixel periods.

The processing circuitry 220 of the controller 20 may further be configured to determine a second jitter delay value J2 based on the data set of forbidden pixel periods and, optionally, on the first jitter delay value J1. The second print data may further define a second holding period 243_2 determined by the second jitter delay value J2. The second jitter delay value J2 may be used by the print data generating circuit 240 to adjust a second holding period 243_2. The print data generating circuitry 240 of the controller 20 may be configured to generate third print data 241_3, which may comprise one or more drive pulses 242_3, based on the third data block 2_3. The time between each first of the one or more drive pulses 242_2 and 242_3 of the second and third print data 241_2 and 241_3 determines a second pixel period $\tau_2$ as shown in FIGS. 5B and 5C. The print data generating circuit 240 is configured to send the third print data 241_3 to control at least one actuating element 110 of the droplet deposition apparatus 1 according to the third data block 2_3.

Therefore, the jitter generating circuitry 210 may be configured to receive (or determine) a first media pixel period based on media encoder signal 311 from the media encoder circuitry 310; and the jitter generating circuitry 210 may be configured to determine a first jitter delay value so as to provide a first pixel period that does not match the media pixel period.

Similarly, the jitter generating circuitry 210 may determine first and second jitter delay values to provide first and second pixel periods that do not match the corresponding media pixel periods.

The media encoder circuitry 310 of the droplet deposition apparatus 1 receiving the media encoder input 31 from the media encoder 30 may be configured to determine a pixel clock PCLK based on the media pixel period determined from the media encoder input 31. The pixel clock PCLK may comprise a plurality of triggers PCLKn that relate to positions on the media at which a pixel should be printed. The media encoder circuitry 310 is configured to send the media encoder signal 311 to the processing circuitry 220. The processing circuitry 220 may determine a virtual pixel clock VPCLK based on the pixel clock that takes into account variations and errors in the pixel clock, to provide optimised virtual pixel clock triggers VPCLKn. The virtual pixel clock represents an optimised forecast of virtual pixel clock triggers based on past media encoder data.

Alternatively the virtual pixel clock VPCLK may be determined by the media encoder circuitry 310 which provides optimised virtual pixel clock triggers VPCLKn to the processing circuitry 220.

Next, the virtual pixel clock triggers VPCLKn may be adjusted to accommodate jitter delay values provided by the jitter generation circuitry 210 so as to ensure that some or each pixel period will fall outside of the data set of forbidden pixel periods.

The jitter generating circuitry 210 may take into account the virtual pixel clock triggers VPCLKn and the corresponding pixel periods based on the virtual pixel clock triggers, and assess which ones of the periods fall within the data set of forbidden pixel periods. For those periods identified as falling within the data set of forbidden pixel periods, suitable jitter delay values may be provided by the jitter generating circuitry 210.

The first, second and subsequent triggers VPCLK1, VPCLK2, VPCLKn of the virtual pixel clock, as adjusted by jitter delay values, are provided as part of control signal 221 to the print data generation circuitry 240. The print data generation circuitry 240 is configured to generate print data 241 based on the virtual pixel clock triggers and based on data blocks 2 that defines the timing of generating the first and second and subsequent actuating element signals 721_1, 721_2, . . . **721_*n* to control the at least one actuating element 110 of the droplet deposition apparatus according to the first and second and subsequent data blocks 2_1, 2_2, . . . 2_*n***.

The processing circuitry 220 may further be configured to assess, over a print duration, the average of a plurality of media pixel periods that occur over the print duration, and identify suitable jitter delay values for those media pixel periods that would cause the corresponding pixel period to fall within a range of forbidden pixel periods, such that the average pixel period of a plurality of actuating element signals matches the average of a plurality of corresponding media pixel periods over the print duration.

The processing circuitry 220 is configured to provide a control signal 221 comprising virtual pixel clock triggers, as adjusted based on jitter delay values, to the print data generation circuitry 240. The print data generation circuit 240 then generates print data **241_*n* based on the corresponding jitter values Jn identified by the jitter generating circuitry 210 and data blocks 2_*n* for each media pixel, and sends a print data 241_*n*** to the at least one actuating element upon receiving a corresponding virtual trigger VPCLKn.

Jitter Generating Circuitry

To illustrate the functionality of the jitter generating circuitry 210 and the generation of the jitter delay values Jn, different implementations of the jitter generation circuitry will now be described in more detail with reference to FIGS. 8A-8E.

Figure 8A:
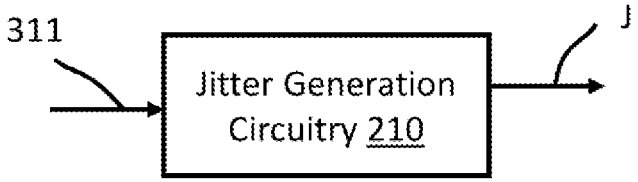
FIG. 8A-E are block diagrams illustrating different types of jitter generation circuitry.

FIG. 8A illustrates the jitter generation circuitry 210 in a general sense, for determining the jitter delay values. The jitter delay values may be determined by the jitter generation circuitry 210 based on the virtual pixel clock triggers as determined from the media encoder signal 311 conveyed by the media encoder circuitry 310 to the jitter generation circuitry 210.

The jitter generation circuitry 210 then transmits the jitter delay value J to the processing circuitry 220, which in turn controls the generation of the control signal 221 and causes the print data generating circuit 240 to generate a holding period based on the jitter delay value J.

Figure 8B:
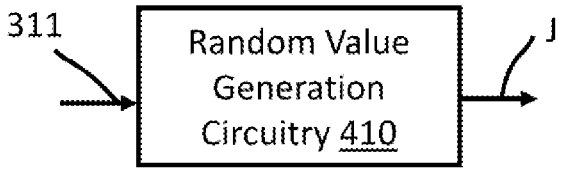

The jitter generation circuitry 210 may take various different forms. For instance, it may comprise random value generation circuitry 410, as shown in FIG. 8B, e.g. that is configured to implement an algorithm which determines random jitter delay values based on the period determined from the virtual pixel clock triggers.

Alternatively, the jitter generation circuitry 210 may comprise a combinatory table from which the jitter generation circuitry selects jitter delay values. To ensure that the jitter delay values vary sufficiently from pixel period to pixel period, the jitter generation circuitry may be configured to cycle between different jitter delay values in the combinatory table.

Alternatively, the jitter generation circuitry may select appropriate jitter delay values based on present and future data blocks and on the media pixel period values determined by the media encoder circuitry 310. For example, the jitter generation circuitry may comprise storage, or have access to storage elsewhere comprised in the control circuitry 20, that allows storing present and future data blocks for analysis and optimisation of jitter delay values chosen from more than one option of applying a jitter delay value, or optimisation of the combination of possible jitter delay values. The jitter generation circuitry may be configured to analyse such present and future print data blocks to select appropriate jitter delay values.

Figure 8C:
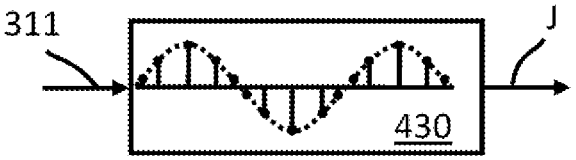

FIG. 8C shows a further implementation of a jitter generation circuitry 430 configured to generate a periodic waveform which is then sampled to determine the jitter delay values based on the period determined from the virtual pixel clock triggers. In some implementations therefore, the jitter delay values may be determined by sampling an independent periodic waveform. This may provide a smooth transition between a range of jitter delay values.

Figure 8D:
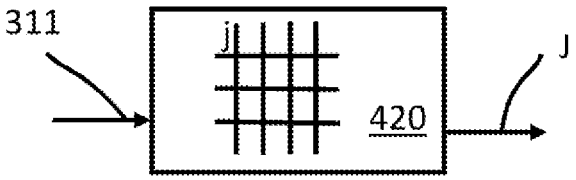

FIG. 8D illustrates a further implementation of a jitter generation circuitry 420. In this example, the jitter generation circuitry 420 comprises a combinatory table of jitter values from which the jitter delay value is chosen. The jitter generation circuitry 420 can cycle between jitter delay values or, alternatively, analyse present and future data blocks and select appropriate jitter delay values based on the virtual pixel periods determined by the media encoder circuitry 310.

In the examples of FIGS. 8B to 8D, the jitter delay values are determined such that the overall average period of the actuating element signals generated from print data corresponds to the media pixel period determined by the media encoder circuitry 310.

Figure 8E:
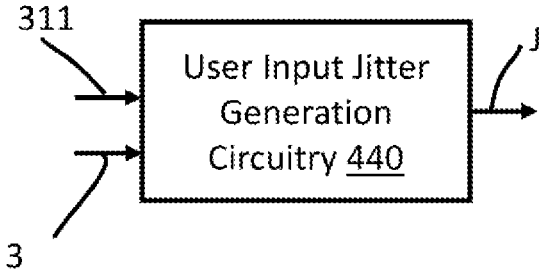

In yet another implementation as shown in FIG. 8E, the jitter generation circuitry 420 may accept user input values which are used to determine suitable jitter delay values.

Separate First and Second Controllers

With regard to the controlling components of the droplet deposition apparatus 1, the above methods and variants may be executed using a single controller.

Alternatively, however, with reference to the components of the droplet deposition apparatus 1, the above methods and variants may be executed by a first controller 20, wherein the step of sending the first and second print data 241 comprises the first controller sending the first and second print data 241 to a second controller 720. Thus, the first controller is configured to perform the steps of: receiving, in the data blocks 2, a first data block for a first line pixel and a second data block for a second line pixel; receiving a data set 3 of forbidden pixel periods that cause harmonic/subharmonic excitation of the meniscus surface and lead to meniscus instability; determining, by the jitter generation circuitry 210, a first jitter delay value based on the data set 3 of forbidden pixel periods; generating, by the print data generating circuit 240, first print data 241 based on the first data block, wherein the first print data comprises data defining a first holding period, determined by the first jitter delay value, and one or more drive pulses; and generating, by the print data generating circuit 240 second print data 241 based on the second data block. The second controller is configured to receive the first and second print data 241 from the first controller and to generate first and second actuating element signals 721, based on respective first and second print data 241, to control the at least one actuating element 110 of the droplet deposition apparatus according to the first and second data blocks 2.

The first controller may further be configured to generate a common drive waveform signal 245 based on data blocks 2, and to send the common drive waveform signal 245 to the second controller. The second controller may further be configured to receive the common drive waveform signal 245 and to the generate the first and second actuating element signals from the common drive waveform signal 245 based on respective first and second print data 241 to control the at least one actuating element of the droplet deposition apparatus according to the first and second data blocks.

Groups of Actuating Elements

Figure 9A:
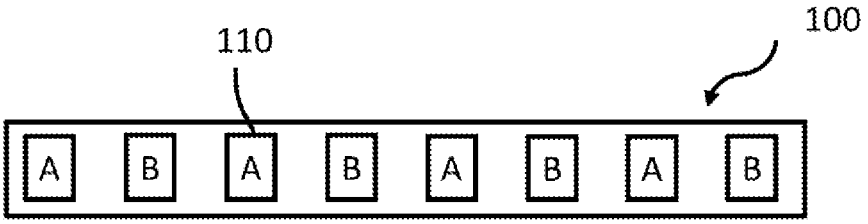
FIG. 9A-C are schematic arrangements of groups of actuating elements.
Figure 9B:
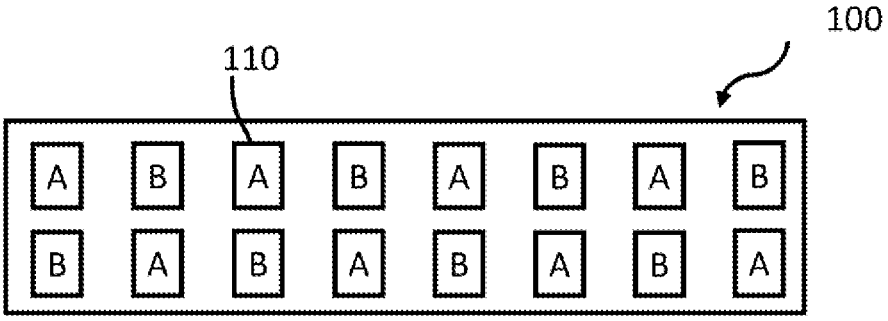
Figure 9C:
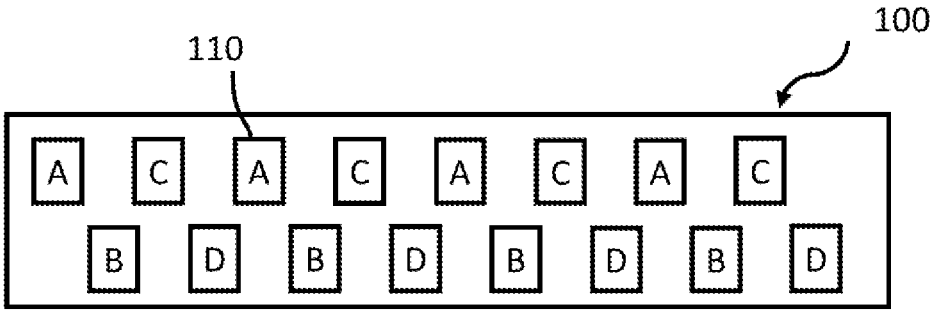

FIGS. 9A to 9C illustrate schematically in plan view, looking down onto the actuating elements 110 along the direction z as indicted in FIG. 1A, several possible arrangements in which multiple actuating elements 110 in an actuator 100 may be grouped. The head control circuitry may receive print data bundled per group within a stream of print data 241.

As shown in FIGS. 9A and 9B, the actuating elements 110 are divided in two groups of actuating elements: the actuating elements 110_A, and actuating elements 110_B. FIGS. 9A and 9B shows that the actuating elements 110 of group A may be interleaved with the piezoelectric elements of group B along two rows. This is by no means essential; other arrangements of the groups of piezoelectric elements may be envisaged without departing from the scope of the embodiments described.

FIG. 9C shows yet another possible arrangement where the actuating elements 110 are divided into four groups of actuating elements, A to D, arranged in two rows of actuating elements 710. In this example, the head control circuitry may receive print data 241A, 241B, 241C and 241D bundled per group within a stream of print data 241.

Figure 10:
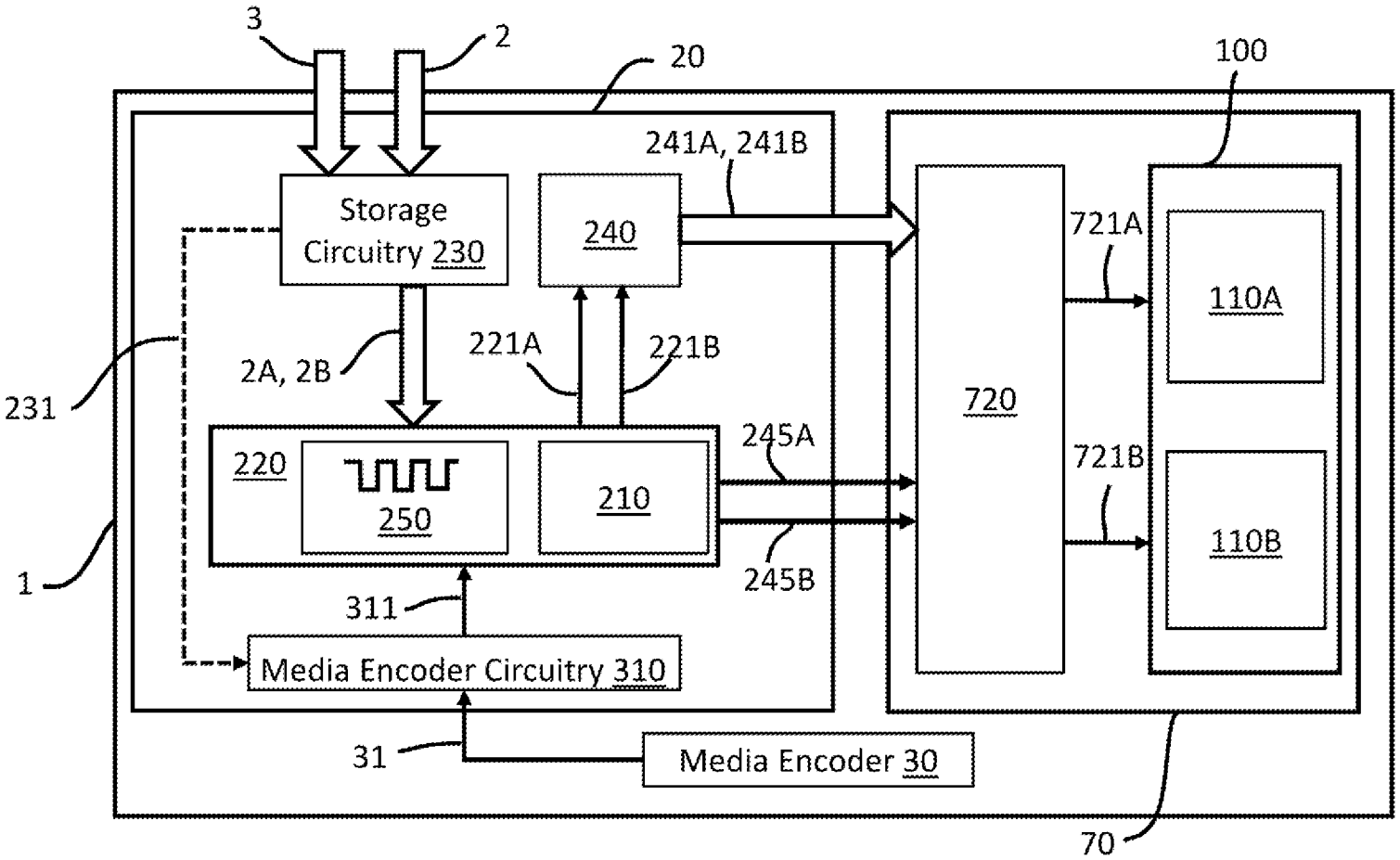
FIG. 10 is a block diagram of a droplet deposition apparatus configured to carry out operations and methods related to applying jitter delay values to two groups of actuating elements.

A droplet deposition apparatus configured to generate actuating element signals for groups of actuating element is illustrated in a block diagram in FIG. 10. It is a variant of the droplet deposition apparatus 1 and like features are identified using like labels. For simplicity, two actuating elements 110A and 110B are shown as part of actuator 100 of printhead 70. The following discussion may be applied similarly to two groups A and B of actuating elements, each group comprising several actuating elements 110. Both elements (or groups) A and B are to be controlled so as to deposit droplets into the same pixel line.

The controller of FIG. 10 comprises a waveform generator 250 as part of the processing control circuitry 220. The waveform generator 250 is configured to generate a common drive waveform signal 245A for actuating element A and a common drive waveform signal 245B for actuating element B, and to send the common drive waveform signals 245A and 245B to the head control circuitry 720.

The processing control circuitry 220 is configured to receive data blocks 2 from an image processing circuitry (not shown). The apparatus control circuitry 20 may further include a storage circuitry 230 configured to receive and store the data blocks 2. The storage circuitry 230 may also be configured to provide a subset of the data blocks 2, for example for more than one line pixel, to the processing circuitry 220 which may separate the subset into first and second data blocks 2A and 2B. The storage circuitry 230 may also store operational data 231 which contains the information regarding the print resolution and characteristics of the media encoder 30. The media encoder circuitry 310 is configured to determine the media pixel periods based on the media encoder input 31 and the operational data 231.

The jitter generating circuitry 210 may take into account the virtual pixel clock triggers VPCLKn based on the media encoder signal 311 and the corresponding pixel periods defined by the virtual pixel clock triggers, and assess which ones of the periods fall within the data set of forbidden pixel periods. For those (or some) periods identified as falling within the data set of forbidden pixel periods, suitable jitter delay values are provided by the jitter generating circuitry 210.

The processing circuitry 220 receives (or determines) the virtual pixel clock triggers VPCLKn based on the media encoder signal 311 and adjusts them to accommodate the jitter delay values provided by the jitter generation circuitry 210. The processing circuitry 220 is configured to provide a control signals 221A and 221B, based on virtual pixel clock triggers as adjusted based on jitter delay values and data blocks 2A and 2B, to the print data generation circuit 240. The control signals 221A and 221B are provided for corresponding actuating elements A and B. The print data generating circuit 240 is configured to generate print data 241A and 241B in a sequential stream (indicated by a common arrow) based on respective control signals 221A and 221B, and to send the a print data 241A and 241B as print data stream 241 to the head control circuitry 720.

The head control circuitry 720 receives the stream of print data 241A and 241B and the common drive waveform signals 245A and 245B, and generates actuating element signal 721A, from the common drive waveform signal 245A based on the print data 241A, to control actuating element 110A. The head control circuitry 720 also generates actuating element signal 721B, from the common drive waveform signal 245B based on the print data 241B, to control actuating element 110B.

While the waveform generator 250 is shown as part of the processing circuitry 220 in FIGS. 4 and 9, in may instead be located outside of the processing circuitry 220 within the controller 20. For example, it may run too hot to be located close by other circuitry. In this case, the waveform generator may either receive data blocks 2, or it may receive the number of drive pulses to generate as part of the common drive waveform. It may receive this from external circuitry, or the processing circuitry 220 may provide the data blocks 2 (or the number of drive pulses). The waveform generator 250 would generate the waveform and send to the head control circuitry 720 from its location within controller 20.

Data Loading For Two Groups/Data Load Sharing

For the groups of actuating elements of FIG. 9C, the actuating elements A and C for example, say, may receive different actuating element signals but may be actuated at substantially the same time, because groups A and C may be intended to print into the same pixel line without unnecessary delay.

The application of a jitter delay value may necessitate analysis of the timing of data loading for the two groups. For example, the print data 241A and 241C may normally be sent in the order AC, such that print data 241A is placed in the stream of print data 241 ahead of print data 241C and print data 241A is thus received by the head control circuitry 720 first. Print data 241C is received by the head control circuitry 720 after it has received print data 241A.

Figure 11:
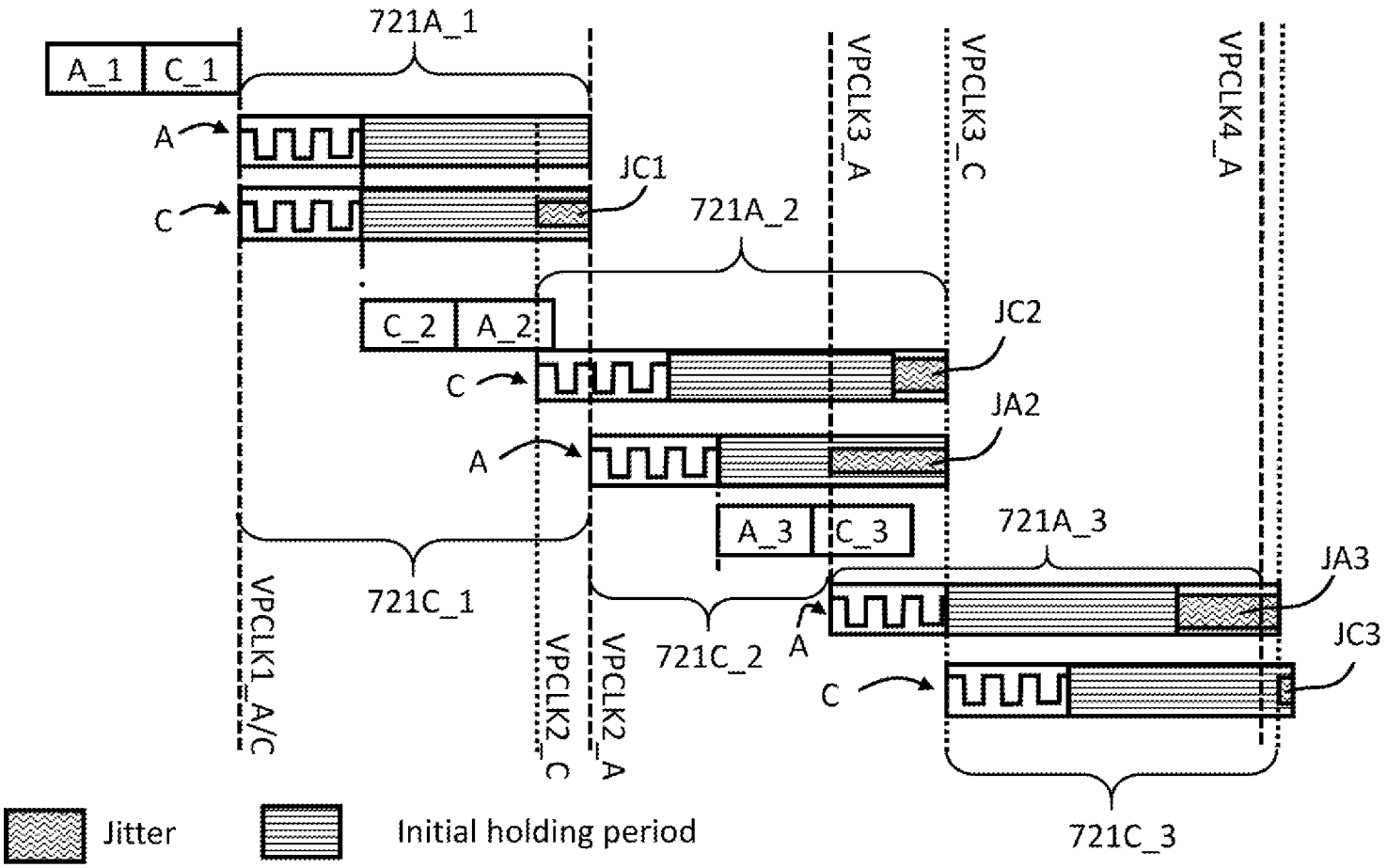
FIG. 11 is an illustration of actuating element signal sequences with jitter delay and data load timings for two groups of actuating elements.

FIG. 11 indicates such a sequential order of data block loading of print data 241A_1 followed by 241C_1 (indicated by A_1 and C_1 in FIG. 11) to the head control circuitry 720, ahead of the head control circuitry 720 generating actuating element signals 721A_1 and 721C_1. Note that FIG. 11 shows evolution of time along the x-axis, i.e. for the first pixel period, data A_1 is received ahead of data C_1.

As soon as both print data 241A_1 and 241C_1 are received, the timing data comprised in print data 241A_1 and 241C_1 based on the virtual pixel clock VPCLK1_A/C triggers the generation of the first actuating element signals 721A_1 and 721C_1 to control group A and group C respectively. In this case the virtual trigger VPCLK1_A/C for both groups is the same.

The actuating element signals 721A and 721C are each comprised of a duration of one or more drive pulses 242A_n and 242C_n, here shown as three drive pulses 242, and a holding period 243A_n and 243C_n respectively, n being the pixel number. The holding period 243_nA and 243_nC may be modified (extended or shortened) from an initial holding period (indicated by the duration of a rectangular shape shaded by horizontal lines) by a jitter delay value (indicated by the duration of a rectangular shape shaded by wavy lines). The holding period is shortened by a negative jitter delay value to the length of the initial holding period less the duration of the jitter delay value, as indicated where the rectangular shape shaded by wavy lines overlies the rectangular shape shaded by horizontal lines, for example as for actuating element signal 721C_1. The holding period is extended by a positive jitter delay value to the length of the initial holding period plus the duration of the jitter delay value, as indicated where the rectangular shape shaded by wavy lines continues from the rectangular shape shaded by horizontal lines, for example as for actuating element signal 721C_2.

It can be seen that actuating element signal 721C_1 comprises a negative jitter delay value, JC1, which shortens the initial holding period to a holding period 243C_1. Meanwhile the initial holding period of actuating element signal 721A_1 is not modified by any jitter delay. As a result, actuating element signal 721C_1 completes before the actuating element signal 721A_1, i.e. the period of actuating element signal 721C_1 is shorter than the period of actuating element signal 721A_1.

In this implementation, the data load for print data 241A_n and 241C_n may begin as soon as both drive pulses 242A_n and 242C_n are complete, where n is the pixel line number. Data load for print data 241A_2 and 241C_2 (indicated by labels A_2 and C_2) therefore may begin as soon as drive pulses 242A_2 and 242C_2 are complete. The normal data load order may be that print data 242A_n is sent ahead of 242C_n by being placed in the stream of print data 241 ahead of 242C_n.

As may be seen, the data load order of print data 241A_2 and 241C_2 (A_2 and C_2) is reversed in the stream of print data for pixel 2. If data C_2 were sent in an unmodified order of data load starting with print data 241A_2, the data load of 241C_2 would complete too late for the second actuating element signal to be generated for group C, which is preferably as soon as the first actuating element signal for C is complete to avoid unnecessary delays. Therefore, it is desirable to swap the order of data load to avoid unnecessary delays in sending the next actuating element signal.

Actuating element signals specifically during periods of acceleration or deceleration of the printhead relative to the media may be analysed ahead of arranging virtual pixel clock triggers and data loading, so that the data load sequence ahead of specific actuating element signals may be reversed to ensure that data blocks are fully loaded when needed, i.e. before the next virtual pixel clock trigger. This may be carried out by the processing control circuitry 220 based on data blocks 2A and 2C for at least present and subsequent line pixels received for groups A and C from storage circuitry 230 and based on corresponding jitter delay values provided by the jitter generation circuitry 210. The processing control circuitry 220 determines a data load order for groups A and C for each line pixel and provides data based on data load order as part of control signals 221A and 221C to the print data generation circuit 240.

For actuating element signals 721_2 of FIG. 11 therefore, the data load order is reversed such that print data 241C_2 is loaded ahead of print data 241A_2, and the second actuating element signal for group C, 721_C2, may be generated based on the trigger of the virtual pixel clock VPCLK2_C as soon as the first actuating element signal 721C_1 is complete. Meanwhile, print data 241A_2 completes loading after print data 241C_2 but ahead of the virtual pixel clock trigger VPCLK2_A, so that the second actuating element signal for group A, 721A_2, may be generated based on the virtual pixel clock trigger VPCLK2_A as soon as the first actuating element signal 721A_1 is complete.

For the second pixel period, in order to ensure that the periods for both actuating element signals 721A_2 and 721C_2 fall outside of the data set of forbidden pixel periods, both holding periods for group A and group C are modified by a respective jitter delay value. For group A, a negative jitter delay value is applied that advances the trigger for the third actuating element signal 721A_3 for group A by a duration JA2 over the initial holding period. The virtual pixel clock trigger VPCLK3_A provides a timing signal in print data 241A_3 (A_3) for the third actuating element signal 721A_3 so that it is ideally placed at the end of the second actuating element signal 721A_2 to avoid unnecessary delays in generating the third actuating element signal 721A_3 for group A. To ensure that the print data 241A_3 (A_3) for the third actuating element signal is available ahead of the earliest possible time for trigger VPCLK3_A, the data load for the third actuating element signal 721A_3 starts with the print data 241A_3 (A_3) for group A. Note how the shortened holding period is just longer than the minimum duration required to complete loading of print data 241A_3. The loading duration of print data therefore defines the minimum holding period as modified by a negative jitter delay value that shortens the initial holding period so as to ensure efficient operation of the droplet deposition apparatus.

For group C, a positive jitter delay value is applied that extends the third actuating element signal 721C_3 for group C by a duration JC2 over the initial holding period. The trigger of the virtual pixel clock VPCLK3_3 that initiates generation of the third actuating element signal is ideally placed at the end of the second actuating element signal 721C_2 to avoid unnecessary delays in generating the third actuating element signal 721C_3 for group C. In this case the data load of print data 241C_3 (C_3) completes ahead of the trigger VPCLK3_C to initiate generation of the third actuating element signal 721C_3.

Note how the data load for print data 241C_3 (C_3) completes slightly after the initial holding period, so that if the pixel period for the second actuating element signal 721C_2 were unmodified by a jitter delay value, the print data 241C_3 (C_3) for the third actuating element signal 721C_3 would not be available as soon as the unmodified second actuating element signal completes. In this case, an offset period may be required to extend the initial holding period so as to ensure that the second actuating element signal for group C is slightly prolonged to allow data loading of the third print data 241C_3 (C_3) for group C to complete.

When analysing the print data for the actuating element signals for groups A and C therefore, an additional requirement for assessing data load order may be to ensure that the second data block also arrives in time for the next actuating element signal to be generated. If an offset is to be applied, it may be necessary to ensure that the offset does not cause the period of the actuating element signal to fall within the data set of forbidden pixel periods. If it does, a jitter delay value may be applied in addition to the offset that extends the holding period to a modified holding period suitable for both completion of data load and for avoiding the data set of forbidden pixel periods.

With respect to FIG. 10, analysis of present and subsequent pixel periods as modified by jitter delay values, in light of data load duration, may be carried out by the processing circuitry 220. The processing circuitry 220 may determine suitable offset values, and where necessary request a renewed determination of jitter delay values from the jitter generation circuitry 210, taking into account virtual pixel clock triggers and offset values. The processing circuitry 220 may be configured to generate control signals 221A and 221B based on modified virtual pixel clock triggers that take into account offset values, renewed jitter delay values, and data blocks 2A and 2B.

The third actuating element signals 721A_3,721C_3 do not need to be explained in great detail as they follow a similar method as for the first and second actuating element signals for groups A and C, except to say that the example shows that, based on the data load order during the periods of the second actuating element signals 721C_2 and 721A_2, the third actuating element signals 721A_3, 721C_3 are triggered by virtual pixel clock triggers VPCLK3_3 and VPCLK3_3. VPCLK3_A occurs ahead of VPCLK3_C and the third actuating element signal 721A_3 for group A is initiated earlier than the third actuating element signal 721C_3 for group C. Actuating element signal 721A_3 is shown modified with a positive jitter delay value JA3, and actuating element signal 721_C3 is shown modified with a small negative jitter delay value JC3.

In the illustration of FIG. 11, the jitter delay values JC1, JC2, JA2, JA3 and JC3 may prevent or reduce meniscus instability in groups A and C for the respective actuating element signals by adjusting (extending or shortening) the corresponding pixel periods of the actuating element signals to fall outside of the data set of forbidden pixel periods. In this schematic illustration of FIG. 11 it is assumed that most or all of the jitter delay values are applied so as to avoid a forbidden pixel period. It is not intended to represent a real example. As discussed above, depending on the properties of the printhead and the actuator, it may not be necessary that each pixel period falls outside of the dataset of forbidden pixel periods, as long as no more than for example 1, 2, 3, 5, or 10 or even more successive pixel periods fall within the dataset of forbidden pixel periods, depending on the damping properties for oscillations within the actuator or printhead.

In some implementations of the above methods, the method may comprise receiving first and second data blocks 2A_1, 2A_2 for respective first and second line pixels for a first actuating element 110A, and third and fourth data blocks 2C_1, 2C_2 for respective first and second line pixels for a second actuating element 110C; receiving a data set of forbidden pixel periods that cause harmonic/subharmonic excitation of the meniscus surface and lead to meniscus instability; determining at least a first jitter delay value for the actuating element signals for the first actuating element based on the data set of forbidden pixel periods, and, optionally, determining a first jitter delay value for the actuating element signals for the second actuating element based on the data set of forbidden pixel periods; and generating a stream of first, second, third and fourth print data 241A_1, 241A_2, 241C_1, 241C_2 based on respectively the first, second, third and fourth data blocks, wherein the at least first jitter delay value for the first actuating element and optionally the first jitter delay value for the second actuating element determines the order of the first, second, third and fourth print data.

Each print data 241 comprises data defining a respective holding period 243, determined by the respective first jitter delay values, and one or more drive pulses 242, and the time between each of the first of the one or more drive pulses 242 defined by the first and third print data 241A_1 and 241A_2, and the time between each of the first of the one or more drive pulses defined by the one or more drive pulses defined by the second and fourth print data 241C_1 and 241C_2, determines a first pixel period for the first actuating element 110A and a first pixel period for the second actuating element 110C; such that each drive pulse causes the first and second actuating elements to eject at least one droplet from a respective nozzle of the droplet deposition apparatus.

The first jitter delay value for the first actuating element signal 721A_1 for the first actuating element adjusts the corresponding first pixel period, and optionally the first jitter delay value for the first actuating element signal 721C_1 for the second actuating element adjusts the corresponding first pixel period to fall outside of the data set of forbidden pixel periods, so as to reduce the occurrence of nozzle meniscus instability.

The method further comprises the step of sending the stream of first, second, third and fourth print data 241A_1, 241A_2, 241C_1, 241C_2 for generating first and second actuating element signals 721A_1, 721A_2 for controlling the first actuating element 110A of the droplet deposition apparatus according to the first and second print data 241A_1, 241A_2; and for generating first and second actuating element signals 721C_1, 721C_2 for controlling the second actuating element 110C of the droplet deposition apparatus according to the second and fourth print data 241C_1, 241C_2. The step of sending the stream of print data is characterised by a data load duration for at least one of the first, second, third and fourth print data, and the step of generating a stream of print data 241A_1, 241A_2, 241C_1, 241C_2 is further based on the data load duration so as to determine the order of the first, second, third and fourth print data 241A_1, 241A_2, 241C_1, 241C_2 in the stream to ensure that each of the first and third and each of the second and fourth print data has been received before the generation of the respective first and second actuating element signals 721_1, 721_2 for the first and second actuating elements 110A, 110C.

The holding period of the actuating element signals for the first, second, third and fourth actuating elements determined by a corresponding jitter delay value may be equal to or greater than the data load duration, such that for a negative first jitter delay value, for the first actuating element, the respective first print data 241A_1 defines a first holding period 243A_1 having a duration that expires as soon as or after the completion of the data load duration for the third print data 241A_2 for the second actuating element signal 721A_2 for the first actuation element 110A to be generated. Alternatively, where first and third holding periods are defined by the first and third print data 241A_1 and 241A_2, the at least first jitter delay value may further be adjusted to ensure that the first holding period 243A_1 has a duration that expires as soon as or after the completion of the data load duration for the third print data 241A_2 for the second actuating element signal 721A_2 for the first actuation element 110A to be generated.

Where first and third holding periods 243A_1, 243A_2 are defined by the first and third print data 241A_1 and 241A_2, and wherein the first holding period 243A_1 is determined by a negative jitter delay value and the third holding period 243A_2 is not determined by a corresponding jitter delay value, the third holding period may be adjusted by an offset value, such that the third holding period is extended by the offset value to have a duration that completes as soon as or after the completion of the data load duration for a fifth print data 241A_3 for a third actuating element signal 721A_3 for the first actuating element 110A to be generated. In this way, the second actuating element signal for the first actuating element may be generated without unnecessary delay.

In some implementations of the methods, the order of the first, second, third and fourth print data may be such that the first print data for the first line pixel for the first actuating element is sent before the third print data for the first line pixel for the second actuating element, and the second print data for the second line pixel for the first actuating element is sent before the fourth print data for the second line pixel for the second actuating element.

Alternatively, the order of the first, second, third and fourth print data may be such that the first print data for the first line pixel for the first actuating element is sent before the third print data for the first line pixel for the second actuating element, and the second print data for the second line pixel for the second actuating element is sent before the fourth print data for the second line pixel for the first actuating element. In other words, the order of data loading for the first and second actuating elements 110A and 110C is swapped from one line pixel to the next.

In the above methods, a first controller 220 may be arranged to determine in advance the order in which the print data 241 for generating the actuating element signals 721 for the first and second actuating elements 110A, 110C are to be sent.

Some droplet deposition apparatus 1 may be configured to carry out the method for reducing nozzle meniscus instability of a droplet deposition apparatus by the steps of receiving a first data block 2_1 for a first line pixel and a second data block 2_2 for a second line pixel; receiving a data set of forbidden pixel periods that cause harmonic/subharmonic excitation of the meniscus surface and lead to meniscus instability; receiving a media encoder signal 31; determining first and second virtual pixel clock triggers relating to the first and second line pixels respectively; determining a first jitter delay value based on the data set of forbidden pixel periods and on the virtual pixel clock triggers; and sending data based on the virtual pixel clock triggers, the first and second data blocks and the first jitter delay value.

The method may further comprise the step of generating a first actuating element signal 721_1 based on the first data block and the first virtual pixel clock trigger, wherein the first actuating element signal 721_1 comprises a first holding period 243, determined by the first jitter delay value, and one or more drive pulses 242; and generating a second actuating element signal 721_2 based on the second data block and the second virtual pixel clock trigger. The second actuating element signal comprises one or more drive pulses 242, and the time between each first of the one or more drive pulses of the first and second actuating element signals determines a first pixel period. The first actuating element signal comprises a first holding period 243_1, determined by the first jitter delay value, and one or more drive pulses 242; and the first and second actuating element signals 721_1, 721_2 control at least one actuating element 110 of the droplet deposition apparatus such that each drive pulse 242 causes the actuating element 110 to eject at least one droplet from a respective nozzle of the droplet deposition apparatus. The first jitter delay value adjusts the first pixel period to fall outside of the data set of forbidden pixel periods so as to reduce the occurrence of nozzle meniscus instability.

In this implementation of the apparatus the steps of generating the actuating element signals 721 is carried out by head control circuitry 720 (second controller) and based only on print data based on media encoder signal 311 and based on data blocks 2. Processing circuitry 220 comprises jitter generation circuitry 210, and may be configured to provide jitter delay values directly to the head control circuitry 720, in which case the head control circuitry is further configured to adjust print data 241 based on the jitter delay values it receives. Alternatively, the processing circuitry 220 may be configured to provide virtual pixel clock data, based on media encoder signals 311 and modified by jitter delay values, to print data generation circuitry 240 along with data based on data blocks 2. The print data generation circuitry generates a print data that comprise the information required by the head control circuitry to generate individual actuating element signals for each awaiting element.

To control the various steps described for the above methods, a controller for a droplet deposition apparatus may be provided, the controller being configured to implement the above methods.

The controller may take the form of a control system, and the control system comprises a first controller 20 configured to implement the steps of receiving a first data block for a first line pixel and a second data block for a second line pixel, as part of data blocks 2; receiving a data set of forbidden pixel periods 3 that cause harmonic/subharmonic excitation of the meniscus surface and lead to meniscus instability; determining a first jitter delay value based on the data set of forbidden pixel periods; generating first print data based on the first data block, wherein the first print data comprises data defining a first holding period, determined by the first jitter delay value, and one or more drive pulses; generating second print data based on the second data block, wherein the second print data comprises data defining one or more drive pulses, the time between each first of the one or more drive pulses defined by the first and second print data determining a first pixel period; and wherein the first and second print data are for generating first and second actuating element signals for controlling at least one actuating element of the droplet deposition apparatus according to the first and second print data; such that each drive pulse causes the actuating element to eject at least one droplet from a respective nozzle of the droplet deposition apparatus; and the first jitter delay value adjusts the first pixel period to fall outside of the data set of forbidden pixel periods so as to reduce the occurrence of nozzle meniscus instability. The first controller may further be configured to carry out all of the above methods apart from the step of generating the first and second actuating element signals based on the respective first and second print data to control the at least one actuating element of the droplet deposition apparatus.

The control system may further comprise a second controller 720 configured to carry out the method of receiving print data signals 241, and optionally a common drive waveform signal 245, and to generate the first and second actuating element signals based on the respective first and second print data (optionally from the common drive waveform) to control the at least one actuating element of the droplet deposition apparatus.

To implement various steps described for the above methods, a droplet deposition apparatus may be provided comprising a droplet deposition head 70 and the first controller 20.

The droplet deposition head may further comprise the second controller 720.

To execute the various steps described for the above methods, a computer program is provided which, when executed by one or more controllers of a droplet deposition apparatus, causes the controller(s) to carry out the above methods.

The invention claimed is:

1. A method for reducing nozzle meniscus instability of a droplet deposition apparatus, the method comprising the steps of:

(a) receiving a first data block for a first line pixel and a second data block for a second line pixel;

(b) receiving a data set of forbidden pixel periods that cause harmonic/subharmonic excitation of the meniscus surface and lead to meniscus instability;

(c) determining at least one first jitter delay value based on the data set of forbidden pixel periods;

(d) generating first print data based on the first data block, wherein the first print data comprises data defining a first holding period, determined by the first jitter delay value, and one or more drive pulses; and (e) generating second print data based on the second data block, wherein the second print data comprises data defining one or more drive pulses, the time between each first of the one or more drive pulses defined by the first and second print data determining a first pixel period;

wherein the first and second print data are for generating first and second actuating element signals for controlling at least one actuating element of the droplet deposition apparatus according to the first and second print data;

such that each drive pulse causes the actuating element to eject at least one droplet from a respective nozzle of the droplet deposition apparatus; and the first jitter delay value adjusts the first pixel period to fall outside of the data set of forbidden pixel periods so as to reduce the occurrence of nozzle meniscus instability.

2. The method of claim 1, further comprising the step of sending the first and second print data to generate the first and second actuating element signals for controlling at least one actuating element of the droplet deposition apparatus according to the first and second print data.

3. The method of claim 1, further comprising the step of generating the first and second actuating element signals based on the respective first and second print data to control the at least one actuating element of the droplet deposition apparatus according to the first and second print data.

4. The method of claim 1, further comprising the step of generating a common drive waveform signal for the at least one actuating element and based on the first and second data blocks, for generating the first and second actuating element signals of the one or more actuating element from the common drive waveform signal and based on the first and second print data.

5. The method of claim 4, further comprising the step of sending the first and second print data and the common drive waveform signal for generating the first and second actuating element signals from the common drive waveform signal based on the first and second print data to control the at least one actuating element of the droplet deposition apparatus.

6. The method of claim 5, further comprising the step of generating the first and second actuating element signals from the common drive waveform signal based on the respective first and second print data to control the at least one actuating element of the droplet deposition apparatus.

7. The method of claim 1, wherein the step of determining a first jitter delay value based on the data set of forbidden pixel periods comprises the steps of receiving media encoder signals, and generating virtual pixel clock triggers based on media encoder signals, wherein the step of generating the first and second print data is further based on the virtual pixel clock triggers.

8. The method of claim 1, wherein the second print data comprises data defining a second holding period, further comprising the steps of:

receiving a third data block for a third line pixel; and generating third print data based on the third data block; wherein the third print data comprises data defining one or more drive pulses, the time between each first of the one or more drive pulses defined by the second and third print data determines a second pixel period, and the second pixel period is adjusted by the first jitter delay value to fall outside the data set of forbidden pixel periods.

9. The method of claim 1 wherein, for a plurality of print data comprising the first and second print data, each of the plurality of print data comprises data to define at least one first drive pulse, successive first drive pulses defined by each of the plurality of print data define respective pixel periods, and a plurality of jitter delay values comprising the at least one first jitter delay value are chosen such that over a print duration portion corresponding to the plurality of print data, the average pixel period defined by the plurality of print data matches the average of a plurality of corresponding media pixel periods that occur over the print duration portion.

10. The method of claim 9, wherein the first jitter delay values is a negative value; the method further comprising determining a virtual pixel clock based on a media pixel period determined by media encoder circuitry, the virtual pixel clock comprising a plurality of virtual triggers;

determining a transposed virtual pixel clock transposed from the virtual pixel clock by the modulus of the first jitter delay value, the transposed virtual pixel clock comprising a plurality of transposed virtual triggers; wherein generating first and second print data is further based on the transposed virtual triggers of the transposed virtual pixel clock so as to define holding periods determined only by positive jitter delay values; and wherein a second jitter delay value is negative, and the transposed virtual pixel clock is transposed from the virtual pixel clock by the maximum value of the moduli of the first and second jitter delay values.

11. The method of claim 1, wherein the at least one first jitter delay value is a negative value; the method further comprising determining a virtual pixel clock based on a media pixel period determined by media encoder circuitry, the virtual pixel clock comprising a plurality of virtual triggers; and determining a transposed virtual pixel clock transposed from the virtual pixel clock by the modulus of the first jitter delay value, the transposed virtual pixel clock comprising a plurality of transposed virtual triggers; wherein generating first and second print data is further based on the transposed virtual triggers of the transposed virtual pixel clock so as to define holding periods determined only by positive jitter delay values.

12. The method of claim 1, wherein the first print data defines the first holding period such that the first holding period is extended by the first jitter delay value if the first jitter delay value is positive; or the first print data defines the first holding period such that the first holding period is shortened by the first jitter delay value if the first jitter delay value is negative.

13. The method of claim 1, wherein the first holding period determined by a corresponding jitter delay value further has a duration at least as long as a data load duration for sending the second print data to head control circuitry.

14. The method of claim 1, further comprising the steps of receiving the first and second data blocks for the respective first and second line pixels for a first actuating element, and third and fourth data blocks for respective first and second line pixels for a second actuating element;

wherein the step of determining the jitter delay values comprises the steps of determining at least a first jitter delay value for the first actuating element signals for the first actuating element based on the data set of forbidden pixel periods;

generating a stream of first, second, third and fourth print data based on respectively the first, second, third and fourth data blocks, wherein the at least first jitter delay value for the first actuating element determines the order of the first, second, third and fourth print data;

wherein each print data comprises data defining a respective holding period, determined by the respective first jitter delay values, and one or more drive pulses;

wherein the time between each of the first of the one or more drive pulses defined by the first and third print data, and the time between each of the first of the one or more drive pulses defined by the second and fourth print data, determines a first pixel period for the first actuating element and a first pixel period for the second actuating element; such that each drive pulse causes the first and second actuating elements to eject at least one droplet from a respective nozzle of the droplet deposition apparatus; and wherein the first jitter delay value for the first actuating element signal for the first actuating element adjusts the corresponding first pixel period to fall outside of the data set of forbidden pixel periods, so as to reduce the occurrence of nozzle meniscus instability; and sending the stream of first, second, third and fourth print data for generating first and second actuating element signals for controlling the first actuating element of the droplet deposition apparatus according to the first and second print data; and for generating first and second actuating element signals for controlling the second actuating element of the droplet deposition apparatus according to the second and fourth print data;

wherein the step of sending the stream of print data is characterised by a data load duration for at least one of the first, second, third and fourth print data;

and wherein the step of generating a stream of print data is further based on the data load duration so as to determine the order of the first, second, third and fourth print data in the stream to ensure that each of the first and third and each of the second and fourth print data has been received before the generation of the respective first and second actuating element signals for the first and second actuating elements.

15. The method of claim 14, wherein the holding period determined by a corresponding jitter delay value is equal or greater than the data load duration, such that for a negative first jitter delay value for the first actuating element, the respective first print data defines a first holding period having a duration that expires as soon as or after the completion of the data load duration for the third print data for the second actuating element signal for the first actuation element to be generated.

16. The method of claim 14, wherein first and third holding periods are defined by the first and third print data, and the at least first jitter delay value is further adjusted to ensure that the first holding period having a duration that expires as soon as or after the completion of the data load duration for the third print data for the second actuating element signal for the first actuation element to be generated.

17. The method of claim 16, wherein first and third holding periods are defined by the first and third print data, and wherein the first holding period is determined by a negative jitter delay value and the third holding period is not determined by a corresponding jitter delay value, the third holding period is adjusted by an offset value, such that the third holding period is extended by the offset value to have a duration that completes as soon as or after the completion of the data load duration for a fifth print data for a third actuating element signal for the first actuating element to be generated.

18. The method of claim 14, further comprising the steps of determining a first jitter delay value for the first actuating element signals for the second actuating element based on the data set of forbidden pixel periods, wherein the first jitter delay value for the first actuating element and the first jitter delay value for the second actuating element determine the order of the first, second, third and fourth print data, and the first jitter delay value for the first actuating element signal for the second actuating element adjusts the corresponding first pixel period.

19. The method of claim 1, wherein the first jitter delay value is chosen to adjust the first and second pixel periods to fall on opposite sides of the data set of forbidden pixel periods; or wherein the first jitter delay value is chosen to adjust one of the first and second pixel periods to fall outside the data set of forbidden pixel periods.

20. A control system for a droplet deposition apparatus having at least one nozzle meniscus, the control system being configured to implement a method, the method comprising the steps of:

(a) receiving a first data block for a first line pixel and a second data block for a second line pixel;

(b) receiving a data set of forbidden pixel periods that cause harmonic/subharmonic excitation of the meniscus surface and lead to meniscus instability;

(c) determining a first jitter delay value based on the data set of forbidden pixel periods;

(d) generating first print data based on the first data block, wherein the first print data comprises data defining a first holding period, determined by the first jitter delay value, and one or more drive pulses; and (e) generating second print data based on the second data block, wherein the second print data comprises data defining one or more drive pulses, the time between each first of the one or more drive pulses defined by the first and second print data determining a first pixel period;

wherein the first and second print data are for generating first and second actuating element signals for controlling at least one actuating element of the droplet deposition apparatus according to the first and second print data;

such that each drive pulse causes the actuating element to eject at least one droplet from a respective nozzle of the droplet deposition apparatus; and the first jitter delay value adjusts the first pixel period to fall outside of the data set of forbidden pixel periods so as to reduce the occurrence of nozzle meniscus instability.

21. A non-transitory computer-readable medium for reducing nozzle meniscus instability in a droplet deposition apparatus having at least one nozzle meniscus, comprising instructions stored thereon, that when executed cause at least one controller to perform the steps of:

(a) receiving a first data block for a first line pixel and a second data block for a second line pixel;

(b) receiving a data set of forbidden pixel periods that cause harmonic/subharmonic excitation of the meniscus surface and lead to meniscus instability;

(c) determining a first jitter delay value based on the data set of forbidden pixel periods;

(d) generating first print data based on the first data block, wherein the first print data comprises data defining a first holding period, determined by the first jitter delay value, and one or more drive pulses; and (e) generating second print data based on the second data block, wherein the second print data comprises data defining one or more drive pulses, the time between each first of the one or more drive pulses defined by the first and second print data determining a first pixel period;

wherein the first and second print data are for generating first and second actuating element signals for controlling at least one actuating element of the droplet deposition apparatus according to the first and second print data;

such that each drive pulse causes the actuating element to eject at least one droplet from a respective nozzle of the droplet deposition apparatus; and the first jitter delay value adjusts the first pixel period to fall outside of the data set of forbidden pixel periods so as to reduce the occurrence of nozzle meniscus instability.

* * * * *